US011527198B2

(12) United States Patent
Zhai

(10) Patent No.: US 11,527,198 B2
(45) Date of Patent: Dec. 13, 2022

(54) PIXEL DRIVING CIRCUIT, DRIVING METHOD THEREOF, DISPLAY PANEL AND DISPLAY DEVICE

(71) Applicant: Hubei Yangtze Industrial Innovation Center Of Advanced Display Co., Ltd., Wuhan (CN)

(72) Inventor: Yingteng Zhai, Wuhan (CN)

(73) Assignee: Hubei Yangtze Industrial Innovation Center Of Advanced Display Co., Ltd., Wuhan (CN)

( * ) Notice: Subject to any disclaimer, the term of this patent is extended or adjusted under 35 U.S.C. 154(b) by 0 days.

(21) Appl. No.: 17/705,473

(22) Filed: Mar. 28, 2022

(65) Prior Publication Data

US 2022/0215797 A1 Jul. 7, 2022

(30) Foreign Application Priority Data

Dec. 9, 2021 (CN) ..... 202111498670.7

(51) Int. Cl.
*G09G 3/32* (2016.01)

(52) U.S. Cl.
CPC ..... *G09G 3/32* (2013.01); *G09G 2300/0842* (2013.01); *G09G 2310/061* (2013.01); *G09G 2320/0633* (2013.01)

(58) Field of Classification Search
CPC ..... G09G 3/32; G09G 2300/0842; G09G 2310/061; G09G 2320/0633; G09G 2310/0264
See application file for complete search history.

(56) References Cited

U.S. PATENT DOCUMENTS

2006/0132053 A1* 6/2006 Cho ..... G09G 3/3258 315/169.3
2018/0301080 A1* 10/2018 Shigeta ..... G09G 3/2014
2019/0325816 A1* 10/2019 Lin ..... G09G 3/3275
2020/0005710 A1* 1/2020 Miyata ..... G09G 3/3233
(Continued)

FOREIGN PATENT DOCUMENTS

CN 1684132 A 10/2005
CN 111009211 A 4/2020
(Continued)

*Primary Examiner* — Andrew Sasinowski
(74) *Attorney, Agent, or Firm* — KDB Firm PLLC

(57) ABSTRACT

Provided are a pixel driving circuit, a driving method thereof, a display panel and a display device. The pixel driving circuit includes a pulse-width adjustment module, an amplitude adjustment module and a light-emitting element. The pulse-width adjustment module is electrically connected to a sweep signal terminal and includes a pulse-width drive transistor. The pulse-width drive transistor is configured to supply a sweep signal supplied from the sweep signal terminal to the amplitude adjustment module. The amplitude adjustment module is configured to control the light emission duration of the light-emitting element according to the sweep signal. In the provided pixel driving circuit, driving method thereof, display panel and display device, a switching-off voltage for switching off the amplitude adjustment module does not need to be supplied additionally, thereby reducing the circuit complexity of a pixel driving circuit.

16 Claims, 14 Drawing Sheets

(56) References Cited

U.S. PATENT DOCUMENTS

| | | | | |
|---|---|---|---|---|
| 2020/0111403 | A1* | 4/2020 | Kim | G09G 3/32 |
| 2021/0210002 | A1* | 7/2021 | Kim | G09G 3/2014 |
| 2021/0217355 | A1* | 7/2021 | Zheng | G09G 3/3258 |

FOREIGN PATENT DOCUMENTS

| | | | |
|---|---|---|---|
| CN | 111369935 | A | 7/2020 |
| CN | 112102772 | A | 12/2020 |
| CN | 113096589 | A | 7/2021 |
| CN | 113990243 | A | 1/2022 |
| CN | 114333685 | A | 4/2022 |

* cited by examiner

In the light emission stage, supplying, by the pulse-width drive transistor, a frequency-sweeping signal supplied from the frequency-sweeping signal terminal to the amplitude adjustment module, and controlling, by the amplitude adjustment module, a light emission duration of the light-emitting element according to the frequency-sweeping signal S3210
FIG. 32
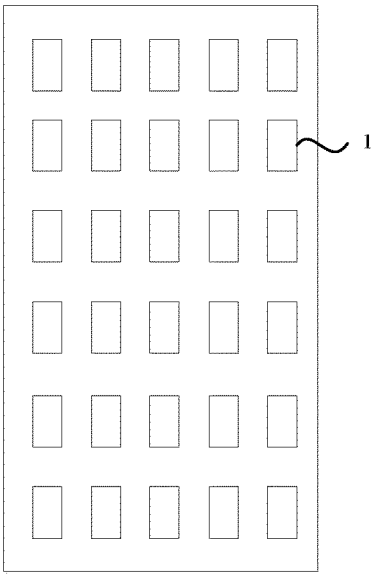
FIG. 33
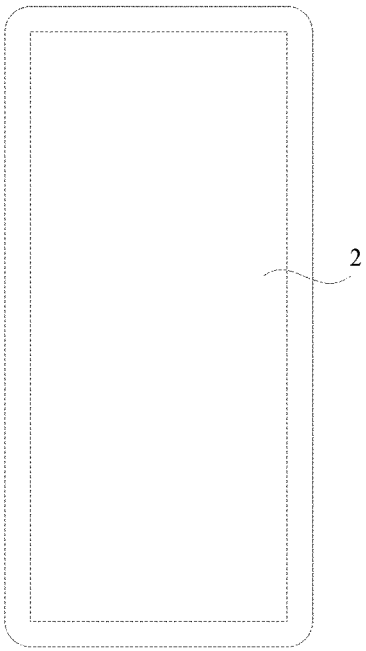
FIG. 34

PIXEL DRIVING CIRCUIT, DRIVING METHOD THEREOF, DISPLAY PANEL AND DISPLAY DEVICE

CROSS-REFERENCE TO RELATED APPLICATION(S)

This application claims priority to Chinese Patent Application No. 202111498670.7 filed Dec. 9, 2021, the disclosure of which is incorporated herein by reference in its entirety.

TECHNICAL FIELD

The present disclosure relates to the field of display technologies and, in particular, to a pixel driving circuit, a driving method thereof, a display panel and a display device.

BACKGROUND

In a display panel in which red light-emitting diodes, green light-emitting diodes and blue light-emitting diodes are driven as sub-pixels, a color scale (or a grayscale) of the sub-pixels is displayed in a pulse-width driving manner.

In a known pixel driving circuit, a switch transistor transmits a switching-off voltage to a control terminal of a driving module according to a potential of a gate of the switch transistor so that the driving module stops driving a pixel light emission unit, thereby making the pixel light emission unit stop emitting light. However, the switching-off voltage cannot be supplied through existing signal lines in the pixel driving circuit, resulting in increasing the circuit complexity of the pixel driving circuit.

SUMMARY

The present disclosure provides a pixel driving circuit, a driving method thereof, a display panel and a display device so that a switching-off voltage for switching off an amplitude adjustment module does not need to be supplied additionally, thereby reducing the circuit complexity of the pixel driving circuit.

In a first aspect, embodiments of the present disclosure provide a pixel driving circuit including a pulse-width adjustment module, an amplitude adjustment module and a light-emitting element. The pulse-width adjustment module is electrically connected to a sweep signal terminal and includes a pulse-width drive transistor. The pulse-width drive transistor is configured to supply a sweep signal supplied from the sweep signal terminal to the amplitude adjustment module. The amplitude adjustment module is configured to control a light emission duration of the light-emitting element according to the sweep signal.

In a second aspect, embodiments of the present disclosure provide a pixel driving circuit including a pulse-width adjustment module, an amplitude adjustment module and a light-emitting element. The pulse-width adjustment module includes a pulse-width drive transistor and a pulse-width adjustment unit. A control terminal of the pulse-width adjustment unit is electrically connected to a pulse-width light emission signal terminal, a first terminal of the pulse-width adjustment unit is electrically connected to a sweep signal terminal, and a second terminal of the pulse-width adjustment unit is electrically connected to a first terminal of the pulse-width drive transistor. An input terminal of the amplitude adjustment module is electrically connected to an output terminal of the pulse-width adjustment module, and an output terminal of the amplitude adjustment module is electrically connected to the light-emitting element.

In a third aspect, embodiments of the present disclosure provide a driving method of a pixel driving circuit. The pixel driving circuit includes a pulse-width adjustment module, an amplitude adjustment module and a light-emitting element. The pulse-width adjustment module is electrically connected to a sweep signal terminal and includes a pulse-width drive transistor. A working process of the pixel driving circuit includes a light emission stage. In the light emission stage, the pulse-width drive transistor supplies a sweep signal supplied from the sweep signal terminal to the amplitude adjustment module, and the amplitude adjustment module controls a light emission duration of the light-emitting element according to the sweep signal.

In a fourth aspect, embodiments of the present disclosure provide a display panel including the pixel driving circuit described in the first aspect or the pixel driving circuit described in the second aspect.

In a fifth aspect, embodiments of the present disclosure provide a display device including the display panel described in the fourth aspect.

BRIEF DESCRIPTION OF DRAWINGS

FIG. 32 is a schematic flowchart of a driving method of a pixel driving circuit according to embodiments of the present disclosure.

FIG. 33 is a schematic diagram of a display panel according to embodiments of the present disclosure.

FIG. 34 is a schematic diagram of a display device according to embodiments of the present disclosure.

DETAILED DESCRIPTION

Figure 1:
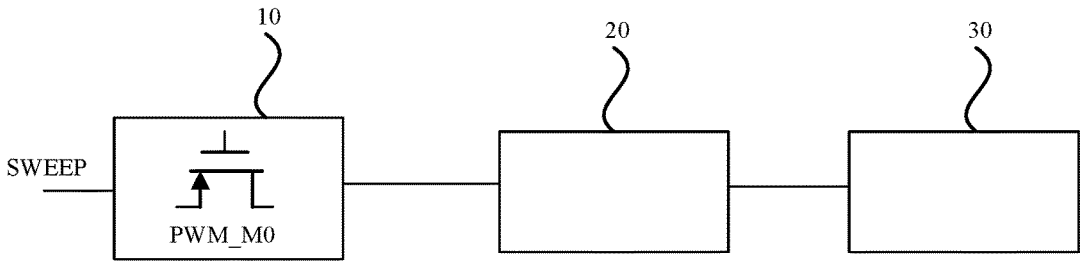
FIG. 1 is a schematic diagram of a pixel driving circuit according to embodiments of the present disclosure.

The present disclosure is further described hereinafter in detail in conjunction with drawings and embodiments. It is to be understood that the embodiments described herein are merely intended to explain the present disclosure and not to limit the present disclosure. Additionally, it is to be noted that for ease of description, only part, not all, of the structures related to the present disclosure are illustrated in the drawings.

FIG. 1 is a schematic diagram of a pixel driving circuit according to embodiments of the present disclosure. Referring to FIG. 1, the pixel driving circuit includes a pulse-width adjustment module 10, an amplitude adjustment module 20 and a light-emitting element 30. The pulse-width adjustment module 10 is electrically connected to a sweep signal terminal SWEEP and includes a pulse-width drive transistor PWM_M0. The pulse-width drive transistor PWM_M0 is configured to supply a sweep signal supplied from the sweep signal terminal SWEEP to the amplitude adjustment module 20. The amplitude adjustment module 20 is configured to control the light emission duration of the light-emitting element 30 according to the sweep signal.

Compared with the related art, in the pixel driving circuit provided by the present embodiments of the present disclosure, the pulse-width drive transistor PWM_M0 is configured to supply the sweep signal supplied from the sweep signal terminal SWEEP to the amplitude adjustment module 20, and the amplitude adjustment module 20 is configured to control the light emission duration of the light-emitting element 30 according to the sweep signal so that a switching-off voltage does not need to be supplied additionally to switch off the amplitude adjustment module 20. That is, the present embodiments of the present disclosure use a sweep signal instead of a switching-off voltage to switch off the amplitude adjustment module 20 so that the light-emitting element 30 is switched off and will not emit light. Therefore, in the pixel driving circuit provided by the present embodiments of the present disclosure, a switching-off voltage for switching off the amplitude adjustment module 20 does not need to be supplied additionally, thereby reducing the circuit complexity of the pixel driving circuit.

Figure 2:
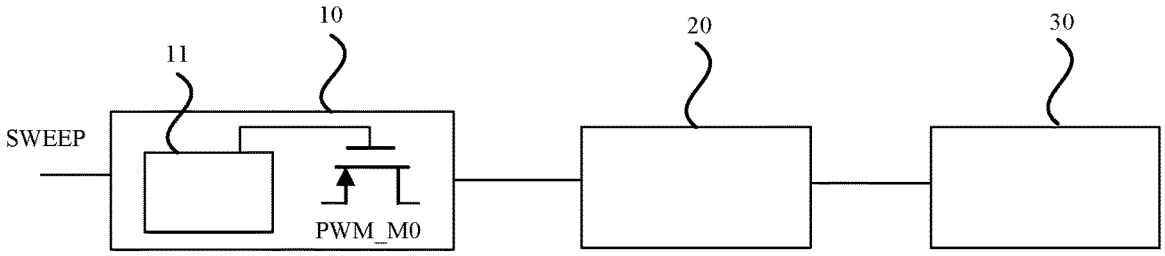
FIG. 2 is another schematic diagram of a pixel driving circuit according to embodiments of the present disclosure.

FIG. 2 is another schematic diagram of a pixel driving circuit according to embodiments of the present disclosure. Referring to FIG. 2, the pulse-width adjustment module 10 further includes a pulse-width data-writing unit 11. The pulse-width data-writing unit 11 is configured to supply a pulse-width data signal to the gate of the pulse-width drive transistor PWM_M0. A working process of the pixel driving circuit includes a data-writing stage. In the data-writing stage, the pulse-width data-writing unit 11 writes the pulse-width data signal into the gate of the pulse-width drive transistor PWM_M0. Hereinafter, how the pulse-width data-writing unit 11 writes the pulse-width data signal into the pulse-width drive transistor PWM_M0 are illustrated as examples.

Figure 3:
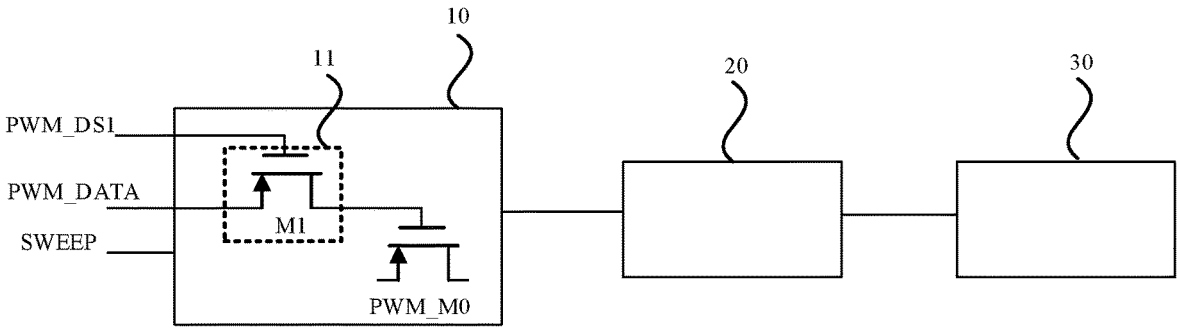
FIG. 3 is another schematic diagram of a pixel driving circuit according to embodiments of the present disclosure.
Figure 4:
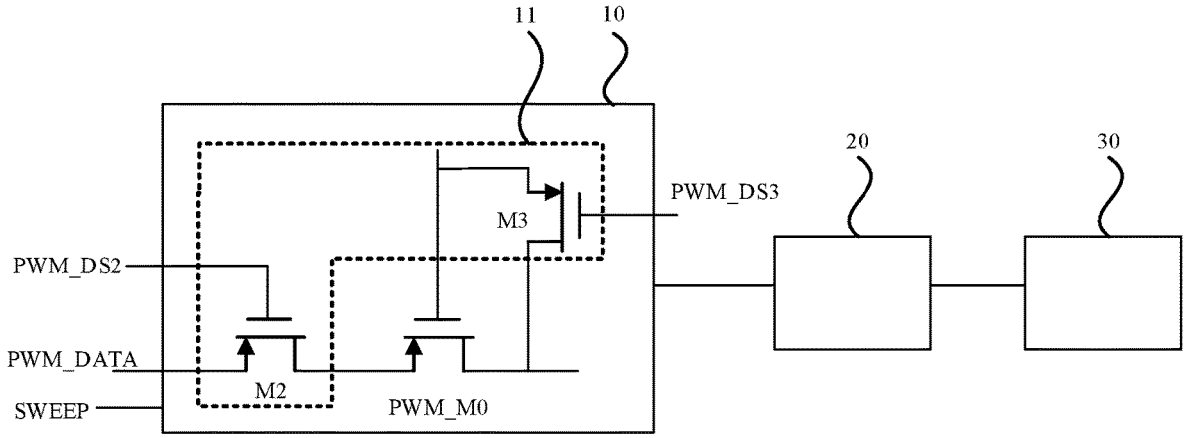
FIG. 4 is another schematic diagram of a pixel driving circuit according to embodiments of the present disclosure.

FIG. 3 is another schematic diagram of a pixel driving circuit according to embodiments of the present disclosure. Referring to FIG. 3, the pulse-width data-writing unit 11 includes a first transistor M1. The first terminal of the first transistor M1 is electrically connected to a pulse-width data signal terminal PWM_DATA, the second terminal of the first transistor M1 is electrically connected to the gate of the pulse-width drive transistor PWM_M0, and the gate of the first transistor M1 is electrically connected to a first pulse-width data-writing scanning-signal terminal PWM_DS1. In the data-writing stage, when an enable signal input from the first pulse-width data-writing scanning-signal terminal PWM_DS1 conducts the first transistor M1, the first transistor M1 supplies the pulse-width data signal from the pulse-width data signal terminal PWM_DATA to the gate of the pulse-width drive transistor PWM_M0. FIG. 4 is another schematic diagram of a pixel driving circuit according to embodiments of the present disclosure. Referring to FIG. 4, the pulse-width data-writing unit 11 includes a second transistor M2 and a third transistor M3. The first terminal of the second transistor M2 is electrically connected to the pulse-width data signal terminal PWM_DATA, the second terminal of the second transistor M2 is electrically connected to the first terminal of the pulse-width drive transistor PWM_M0, and the gate of the second transistor M2 is electrically connected to a second pulse-width data-writing scanning-signal terminal PWM_DS2. The first terminal of the third transistor M3 is electrically connected to the second terminal of the pulse-width drive transistor PWM_M0, the second terminal of the third transistor M3 is electrically connected to the gate of the pulse-width drive transistor PWM_M0, and the gate of the third transistor M3 is electrically connected to a third pulse-width data-writing scanning-signal terminal PWM_DS3.

In one implementation, due to the electrical connection between the second pulse-width data-writing scanning-signal terminal PWM_DS2 and the third pulse-width data-writing scanning-signal terminal PWM_DS3, the same electrical signal is supplied to the second pulse-width data-writing scanning-signal terminal PWM_DS2 and the third pulse-width data-writing scanning-signal terminal PWM_DS3, thereby simultaneously controlling the second transistor M2 and the third transistor M3 to be conducted or to be cut off. In the data-writing stage, when an enable signal input from the second pulse-width data-writing scanning-signal terminal PWM_DS2 conducts the second transistor M2, and an enable signal input from the third pulse-width data-writing scanning-signal terminal PWM_DS3 conducts the third transistor M3, the pulse-width data signal from the pulse-width data signal terminal PWM_DATA is supplied to the gate of the pulse-width drive transistor PWM_M0 through the second transistor M2, the pulse-width drive transistor PWM_M0 and the third transistor M3. The third transistor M3 plays a role in compensating for the threshold voltage of the pulse-width drive transistor PWM_M0.

In another implementation, the second pulse-width data-writing scanning-signal terminal PWM_DS2 and the third pulse-width data-writing scanning-signal terminal PWM_DS3 are configured to supply different electrical signals, to control the second transistor M2 and the third transistor M3 to be conducted or to be cut off, respectively.

Figure 5:
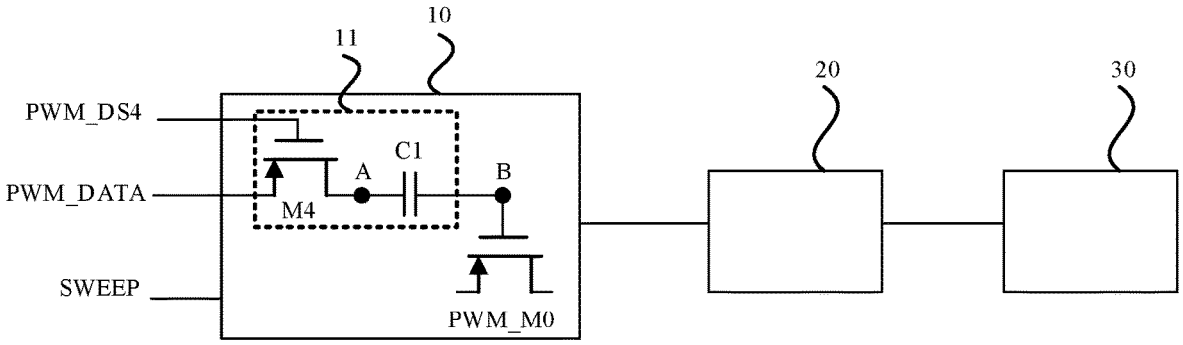
FIG. 5 is another schematic diagram of a pixel driving circuit according to embodiments of the present disclosure.

FIG. 5 is another schematic diagram of a pixel driving circuit according to embodiments of the present disclosure. Referring to FIG. 5, the pulse-width data-writing unit 11 includes a fourth transistor M4 and a first capacitor C1. The first terminal of the fourth transistor M4 is electrically connected to the pulse-width data signal terminal PWM_DATA, and the gate of the fourth transistor M4 is electrically connected to a fourth pulse-width data-writing scanning-signal terminal PWM_DS4. The first plate of the first capacitor C1 is electrically connected to the second terminal of the fourth transistor M4, and the first plate of the first capacitor C1 and the second terminal of the fourth transistor M4 are each connected to a node A. The second plate of the first capacitor C1 is electrically connected to the gate of the pulse-width drive transistor PWM_M0, and the second plate of the first capacitor C1 and the gate of the pulse-width drive transistor PWM_M0 are each connected to a node B. In the data-writing stage, when an enable signal input from the fourth pulse-width data-writing scanning-signal terminal PWM_DS4 conducts the fourth transistor M4, the pulse-width data signal from the pulse-width data signal terminal PWM_DATA is supplied to the first plate of the first capacitor C1 through the fourth transistor M4 and is coupled to the second plate of the first capacitor C1 through a capacitive coupling action, so that the pulse-width data signal is supplied to the gate of the pulse-width drive transistor PWM_M0. In the present embodiments, the pixel driving circuit may further include a pulse-width reset unit (not shown in FIG. 5). The pulse-width reset unit is configured to supply a reset voltage to the node B.

Figure 6:
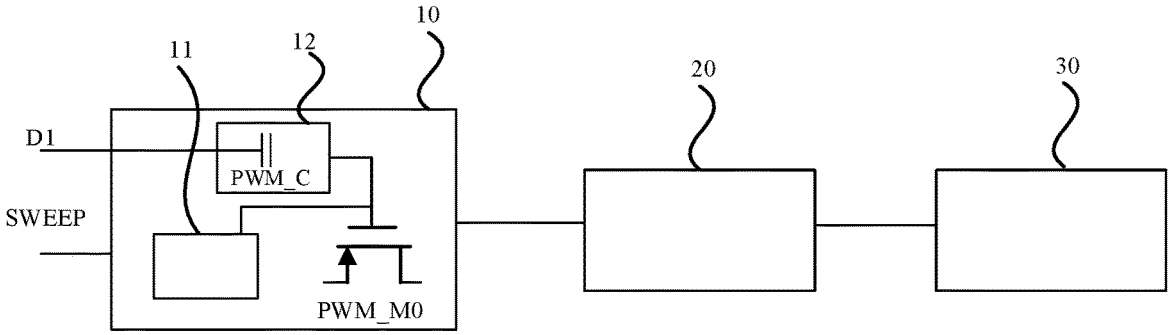
FIG. 6 is another schematic diagram of a pixel driving circuit according to embodiments of the present disclosure.

FIG. 6 is another schematic diagram of a pixel driving circuit according to embodiments of the present disclosure. Referring to FIG. 6, the pulse-width adjustment module 10 further includes a pulse-width storage unit 12. The pulse-width storage unit 12 is configured to store a pulse-width data signal. The pulse-width storage unit 12 is configured to store the pulse-width data signal written into the gate of the pulse-width drive transistor PWM_M0 in the data-writing stage and supply the held pulse-width data signal to the gate of the pulse-width drive transistor PWM_M0 in the light emission stage.

In some embodiments, referring to FIG. 6, the pulse-width storage unit 12 includes a pulse-width storage capacitor PWM_C. The first plate of the pulse-width storage capacitor PWM_C is electrically connected to a first voltage terminal D1. The first voltage terminal D1 is configured to supply a constant voltage. In one implementation, an existing constant voltage in the pixel driving circuit is supplied to the first voltage terminal D1. In another implementation, a newly-added constant voltage may be supplied to the first voltage terminal D1. Hereinafter, how the pulse-width storage capacitor PWM_C is connected is illustrated as examples.

Figure 7:
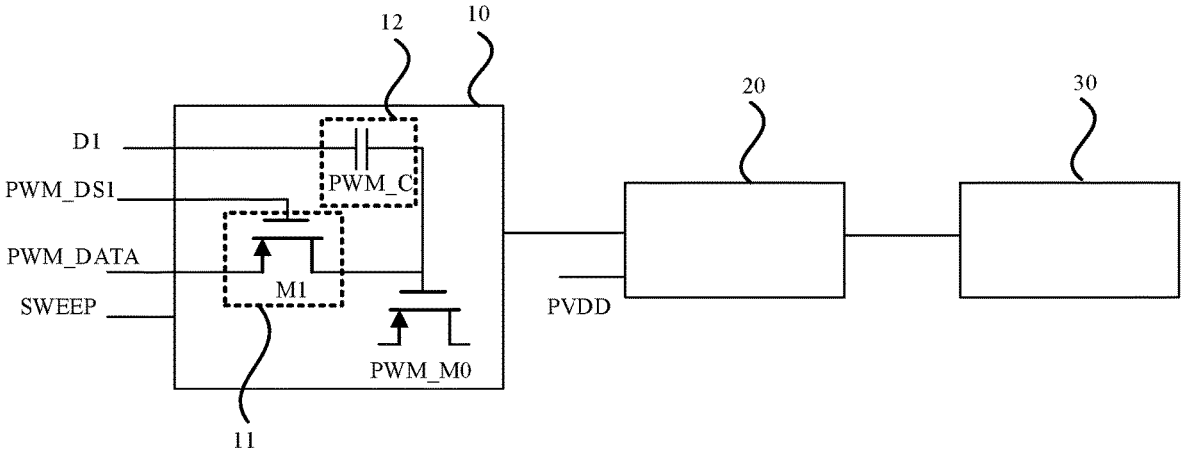
FIG. 7 is another schematic diagram of a pixel driving circuit according to embodiments of the present disclosure.
Figure 8:
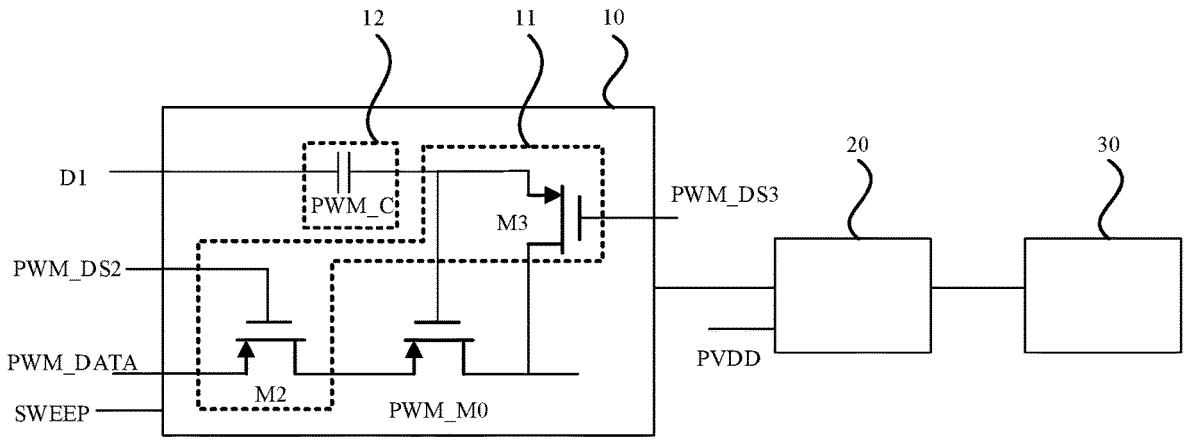
FIG. 8 is another schematic diagram of a pixel driving circuit according to embodiments of the present disclosure.

FIG. 7 is another schematic diagram of a pixel driving circuit according to embodiments of the present disclosure, and FIG. 8 is another schematic diagram of a pixel driving circuit according to embodiments of the present disclosure. Referring to FIG. 7 or FIG. 8, the first plate of the pulse-width storage capacitor PWM_C is electrically connected to the first voltage terminal D1, and the second plate of the pulse-width storage capacitor PWM_C is electrically connected to the gate of the pulse-width drive transistor PWM_M0. The pulse-width data signal written into the gate of the pulse-width drive transistor PWM_M0 in the data-writing stage is also written into the second plate of the pulse-width storage capacitor PWM_C, so that the pulse-width data signal is stored by the pulse-width storage capacitor PWM_C which is configured to hold a potential of the gate of the pulse-width drive transistor PWM_M0.

Figure 9:
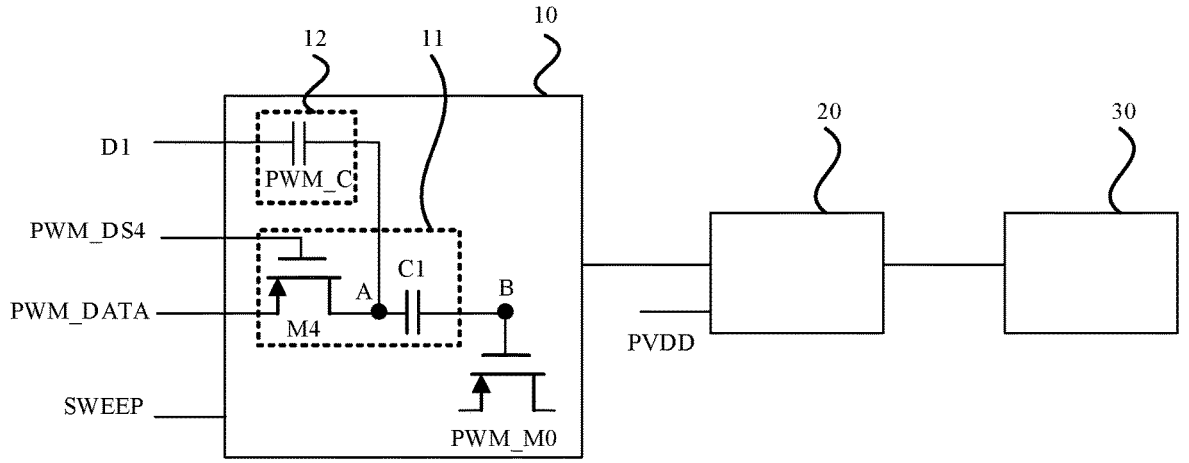
FIG. 9 is another schematic diagram of a pixel driving circuit according to embodiments of the present disclosure.

FIG. 9 is another schematic diagram of a pixel driving circuit according to embodiments of the present disclosure. Referring to FIG. 9, the first plate of the pulse-width storage capacitor PWM_C is electrically connected to the first voltage terminal D1, the second plate of the pulse-width storage capacitor PWM_C is electrically connected to the first plate of the first capacitor C1, and the second plate of the first capacitor C1 is electrically connected to the gate of the pulse-width drive transistor PWM_M0. The second plate of the pulse-width storage capacitor PWM_C is connected to the gate of the pulse-width drive transistor PWM_M0 through the first capacitor C1. The pulse-width data signal written into the first plate of the first capacitor C1 in the data-writing stage is also written into the second plate of the pulse-width storage capacitor PWM_C, so that the pulse-width data signal is stored by the pulse-width storage capacitor PWM_C. The pulse-width storage capacitor PWM_C is configured to hold the potential of the connection node (that is the node A) between the fourth transistor M4 and the first capacitor C1.

In some embodiments, referring to FIGS. 7 to 9, the amplitude adjustment module 20 is electrically connected to a first power terminal PVDD. The first power terminal PVDD may be configured to supply a first power voltage pvdd. The first voltage terminal D1 is electrically connected to the first power terminal PVDD. In the present embodiments of the present disclosure, the first power voltage pvdd is supplied to the first voltage terminal D1. That is, the first voltage terminal D1 is electrically connected to the first power terminal PVDD so that a port therefor can be multiplexed, thereby reducing a number of signal lines used.

As an example, referring to FIG. 9, the pulse-width drive transistor PWM_M0 is configured to supply the sweep signal supplied from the sweep signal terminal SWEEP to the amplitude adjustment module 20. A maximum voltage value of the sweep signal is denoted as SWEEP_MAX, a minimum voltage value of the sweep signal is denoted as SWEEP_MIN, a high-level voltage is denoted as vgh, a low-level voltage is denoted as vgl, the first power voltage supplied from the first power terminal PVDD is denoted as pvdd, a second power voltage supplied from a second power terminal PVEE is denoted as pvee, and the pulse-width data signal from the pulse-width data signal terminal PWM_DATA is denoted as PWM_data. It is satisfied that vgl<pvee<pvdd<SWEEP_MIN<M0_VG<SWEEP_MAX<vgh. The high-level voltage vgh and the low-level voltage vgl are signals supplied to the first pulse-width data-writing scanning-signal terminal PWM_DS1, the second pulse-width data-writing scanning-signal terminal PWM_DS2, the third pulse-width data-writing scanning-signal terminal PWM_DS3 or the fourth pulse-width data-writing scanning-signal terminal PWM_DS4. M0_VG denotes a voltage of the gate of the pulse-width drive transistor PWM_M0. As an example, voltages of various signals of a display panel may be provided as: −10 V≤vgl≤−5 V, −1 V≤pvee≤0 V, 2.5 V≤pvdd≤5.5 V, and 7V≤vgh≤10 V. Taking the pixel driving circuit of FIG. 3 as an example, the voltage of the gate of the pulse-width drive transistor PWM_M0 is equal to the pulse-width data signal PWM_data, so the preceding relation formula may be expressed: vgl<pvee<pvdd<SWEEP_MIN<PWM_data<SWEEP_MAX<vgh. Taking the pixel driving circuit of FIG. 11 as an example, the voltage of the gate of the pulse-width drive transistor PWM_M0 is equal to a boosted voltage of the pulse-width data signal PWM_data. In other arrangements of the pixel driving circuit, the preceding relation formula may be adjusted adaptably according to the voltage of the gate of the pulse-width drive transistor PWM_M0. For example, if the voltage of the gate of the pulse-width drive transistor PWM_M0 is not equal to the pulse-width data signal PWM_data, and some additional voltages are superposed on the basis of the pulse-width data signal PWM_data, which makes that the preceding relation formula is changed. These additional voltages may include, for example, a threshold voltage of the pulse-width drive transistor and/or a boosted voltage under a bootstrap action of a capacitance.

Figure 10:
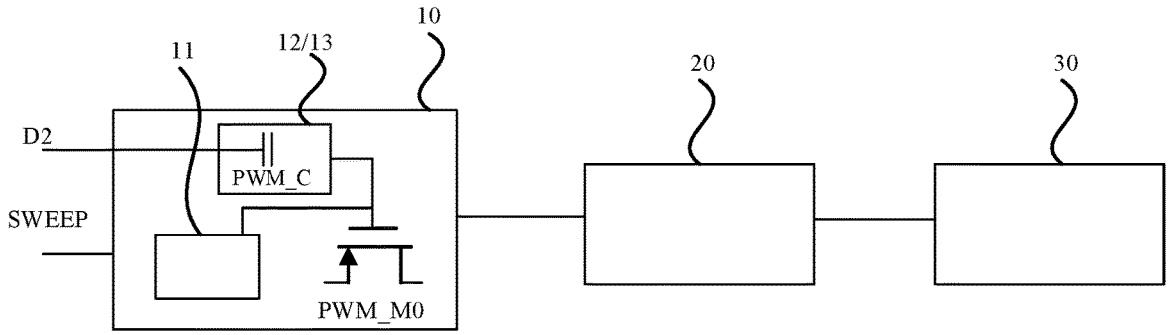
FIG. 10 is another schematic diagram of a pixel driving circuit according to embodiments of the present disclosure.

FIG. 10 is another schematic diagram of a pixel driving circuit according to embodiments of the present disclosure. Referring to FIG. 10, the pulse-width storage unit 12 includes the pulse-width storage capacitor PWM_C. The first plate of the pulse-width storage capacitor PWM_C is electrically connected to a second voltage terminal D2. The voltages supplied from the second voltage terminal D2 include a first voltage value and a second voltage value that are different from each other. In the present embodiments of the present disclosure, the pulse-width storage capacitor PWM_C also serves as a data voltage boosting unit 13. The voltage change of the second voltage terminal D2 is fed through to the gate of the pulse-width drive transistor PWM_M0 through a coupling action of the pulse-width storage capacitor PWM_C, to boost the voltage of the gate of the pulse-width drive transistor PWM_M0. In this manner, the voltage range of the pulse-width data signal supplied from the pulse-width data signal terminal PWM_DATA can be reduced, thereby reducing consumption of a driver chip (IC) for supplying the pulse-width data signal to the pulse-width data signal terminal PWM_DATA and eliminating technical difficulty for supply a higher voltage.

Figure 11:
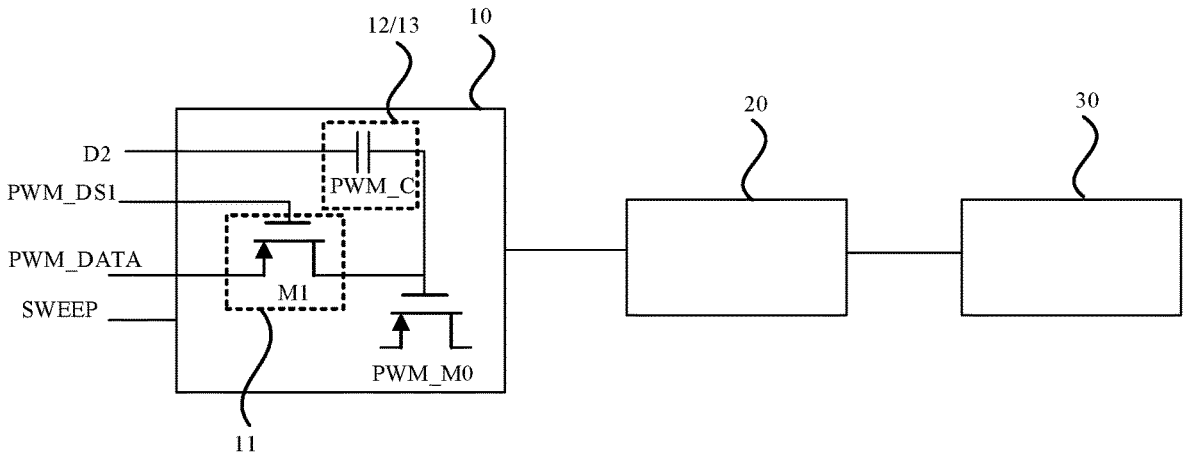
FIG. 11 is another schematic diagram of a pixel driving circuit according to embodiments of the present disclosure.

FIG. 11 is another schematic diagram of a pixel driving circuit according to embodiments of the present disclosure. Referring to FIG. 11, the first plate of the pulse-width storage capacitor PWM_C is electrically connected to the second voltage terminal D2, and the second plate of the pulse-width storage capacitor PWM_C is electrically connected to the gate of the pulse-width drive transistor PWM_M0. It is to be understood that in other embodiments, the second plate of the pulse-width storage capacitor PWM_C may also be connected to the gate of the pulse-width drive transistor PWM_M0 indirectly. For example, when the first voltage terminal D1 of FIG. 9 is replaced with the second voltage terminal D2, the second plate of the pulse-width storage capacitor PWM_C is connected to the gate of the pulse-width drive transistor PWM_M0 through the first capacitor C1.

Figure 12:
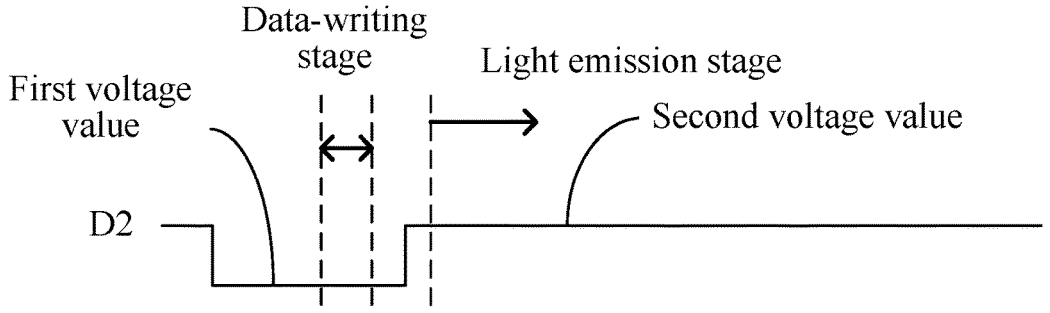
FIG. 12 is a schematic timing diagram of a pixel driving circuit according to embodiments of the present disclosure.

FIG. 12 is a schematic timing diagram of a pixel driving circuit according to embodiments of the present disclosure. Referring to FIGS. 11 and 12, the working process of the pixel driving circuit includes a data-writing stage and the light emission stage, and the data-writing stage occurs before the light emission stage. In the data-writing stage, a voltage having the first voltage value is supplied from the second voltage terminal D2, and the first transistor M1 is conducted so that the pulse-width data signal is written into the gate of the pulse-width drive transistor PWM_M0. The voltage supplied from the second voltage terminal D2 is increased from the first voltage value to the second voltage value, the voltage of the first plate of the pulse-width storage capacitor PWM_C is increased from the first voltage value to the second voltage value, and the voltage of the second plate of the pulse-width storage capacitor PWM_C increases through the coupling action of the pulse-width storage capacitor PWM_C, thereby boosting the voltage of the gate of the pulse-width drive transistor PWM_M0. That is, a voltage boost is performed on the basis of the voltage of the original pulse-width data signal of the gate of the pulse-width drive transistor PWM_M0. In this manner, the voltage range of the pulse-width data signal (that is the pulse-width data signal written into the gate of the pulse-width drive transistor PWM_M0) supplied from the pulse-width data signal terminal PWM_DATA can be smaller. For example, the voltage value of the pulse-width data signal may be provided according to an existing data voltage range (for example, 0 V to 5 V) and is needed to be greater than 5 V. Subsequently, in the light emission stage, a voltage having the second voltage value is supplied from the second voltage terminal D2, to hold the boosted potential of the gate of the pulse-width drive transistor PWM_M0.

As an example, referring to FIG. 12, a difference between the first voltage value and the second voltage value is smaller than half of a difference between the high-level voltage vgh and the low-level voltage vgl, to control an increase amount of the pulse-width data voltage and to prevent the pulse-width data voltage from being increased excessively, so that the voltage value of the pulse-width data signal written into the gate of the pulse-width drive transistor PWM_M0 can be provided according to the existing data voltage range, and it is not necessarily to redesign the voltage value of the pulse-width data signal to be either a higher voltage value or a lower voltage value (for example, −5 V to 0 V).

Figure 13:
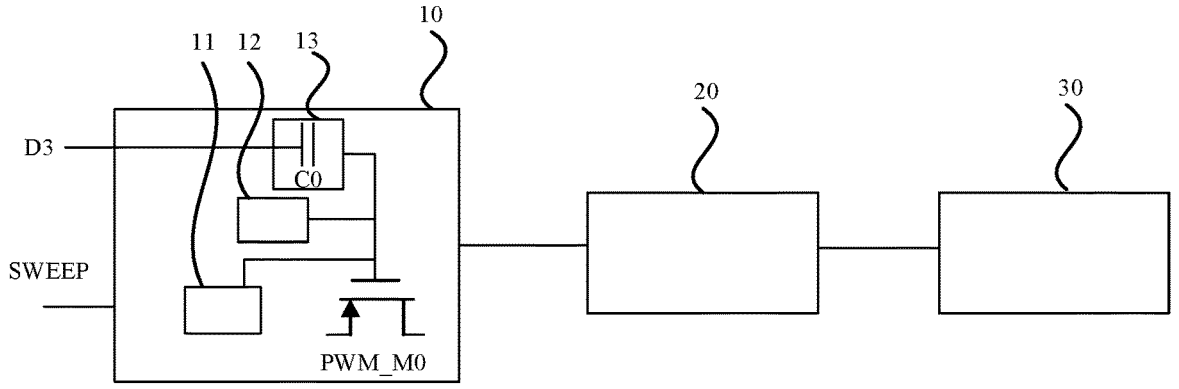
FIG. 13 is another schematic diagram of a pixel driving circuit according to embodiments of the present disclosure.

FIG. 13 is another schematic diagram of a pixel driving circuit according to embodiments of the present disclosure. Referring to FIG. 13, the pulse-width adjustment module 10 further includes the data voltage boosting unit 13. The data voltage boosting unit 13 is configured to boost the pulse-width data signal stored in the pulse-width storage unit 12. That is, the data voltage boosting unit 13 is configured to boost the potential of the gate of the pulse-width drive transistor PWM_M0 held by the pulse-width storage unit 12. In the present embodiments of the present disclosure, one data voltage boosting unit 13 is added additionally to boost the voltage of the gate of the pulse-width drive transistor PWM_M0. In this manner, the voltage value of the pulse-width data signal written into the gate of the pulse-width drive transistor PWM_M0 can be provided according to the existing data voltage range, and it is not necessarily to redesign the voltage value of the pulse-width data signal to be a higher voltage value.

In some embodiments, referring to FIG. 13, the data voltage boosting unit 13 includes a feedthrough capacitor C0. The first plate of the feedthrough capacitor C0 is electrically connected to a third voltage terminal D3. The voltages supplied from the third voltage terminal D3 include a third voltage value and a fourth voltage value that are different from each other. The voltage change of the third voltage terminal D3 is fed through to the gate of the pulse-width drive transistor PWM_M0 through the coupling action of the feedthrough capacitor C0 to boost the voltage of the gate of the pulse-width drive transistor PWM_M0. Hereinafter, how the feedthrough capacitor C0 is connected is illustrated as examples.

Figure 14:
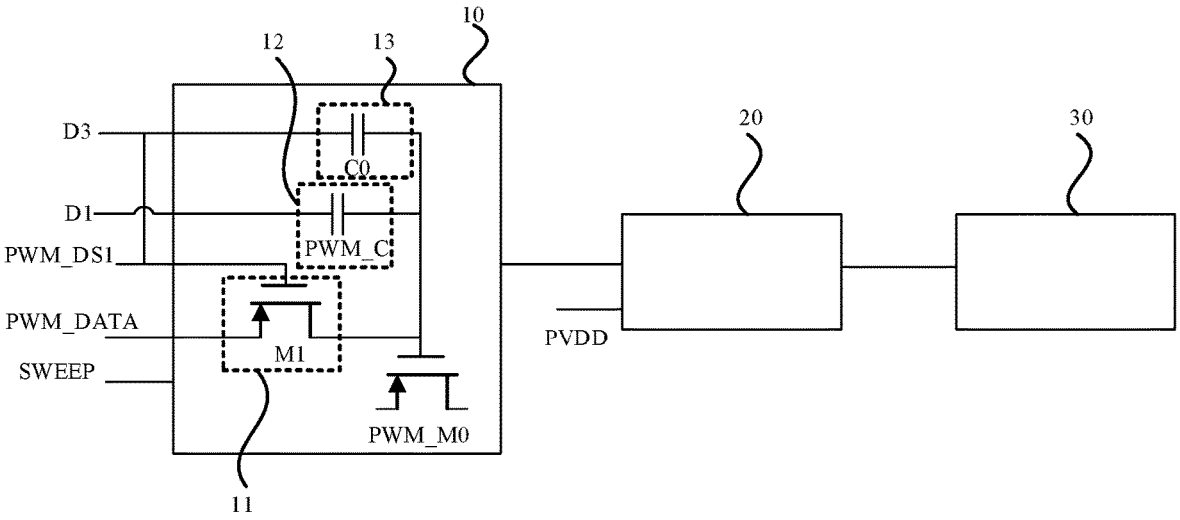
FIG. 14 is another schematic diagram of a pixel driving circuit according to embodiments of the present disclosure.

FIG. 14 is another schematic diagram of a pixel driving circuit according to embodiments of the present disclosure. Referring to FIG. 14, the pulse-width data-writing unit 11 includes the first transistor M1. The first terminal of the first transistor M1 is electrically connected to the pulse-width data signal terminal PWM_DATA, the second terminal of the first transistor M1 is electrically connected to the gate of the pulse-width drive transistor PWM_M0, and the gate of the first transistor M1 is electrically connected to the first pulse-width data-writing scanning-signal terminal PWM_DS1. The third voltage terminal D3 is electrically connected to the first pulse-width data-writing scanning-signal terminal PWM_DS1 so that a port therefor can be multiplexed, and an existing signal line in the pixel driving circuit can supply a same electrical signal to the third voltage terminal D3 and the first pulse-width data-writing scanning-signal terminal PWM_DS1. In the present embodiments of the present disclosure, the first transistor M1 may be a P-type transistor. In the data-writing stage, a low-level signal from the first pulse-width data-writing scanning-signal terminal PWM_DS1 conducts the first transistor M1, and after the data-writing stage is ended, the control signal from the first pulse-width data-writing scanning-signal terminal PWM_DS1 is boosted to be at a high level to cut off the first transistor M1, and the potential of the gate of the pulse-width drive transistor PWM_M0 is boosted through the feedthrough action of the feedthrough capacitor C0.

Figure 15:
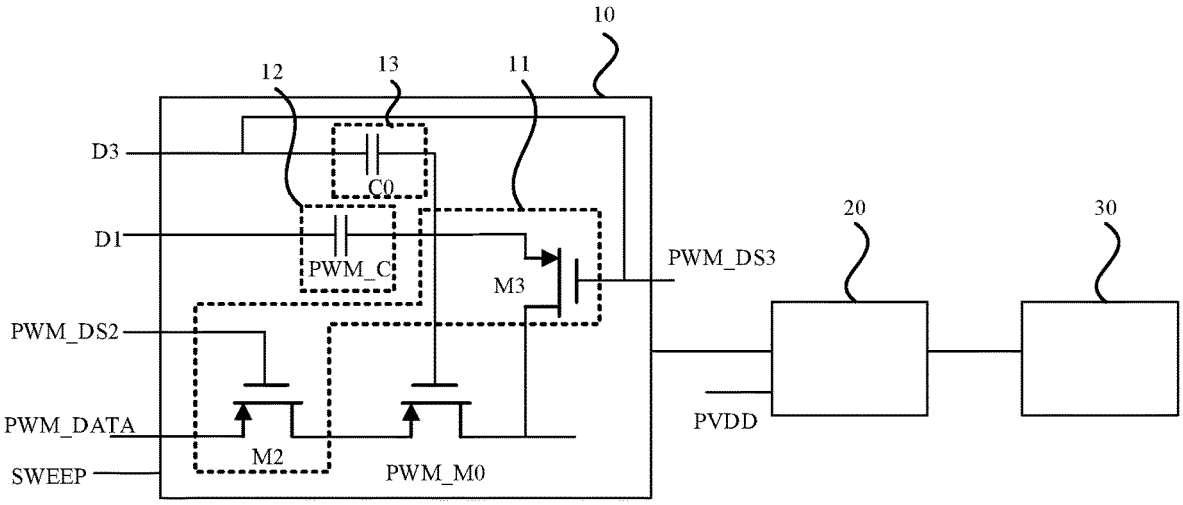
FIG. 15 is another schematic diagram of a pixel driving circuit according to embodiments of the present disclosure.

FIG. 15 is another schematic diagram of a pixel driving circuit according to embodiments of the present disclosure. Referring to FIG. 15, the pulse-width data-writing unit 11 includes the second transistor M2 and the third transistor M3. The first terminal of the second transistor M2 is electrically connected to the pulse-width data signal terminal PWM_DATA, the second terminal of the second transistor M2 is electrically connected to the first terminal of the pulse-width drive transistor PWM_M0, and the gate of the second transistor M2 is electrically connected to the second pulse-width data-writing scanning-signal terminal PWM_DS2. The first terminal of the third transistor M3 is electrically connected to the second terminal of the pulse-width drive transistor PWM_M0, the second terminal of the third transistor M3 is electrically connected to the gate of the pulse-width drive transistor PWM_M0, the gate of the third transistor M3 is electrically connected to the third pulse-width data-writing scanning-signal terminal PWM_DS3, and the third voltage terminal D3 is electrically connected to the third pulse-width data-writing scanning-signal terminal PWM_DS3. An existing signal line in the pixel driving circuit is used for supplying the same electrical signal to the third voltage terminal D3 and the third pulse-width data-writing scanning-signal terminal PWM_DS3. In the present embodiments of the present disclosure, the third transistor M3 may be a P-type transistor. In the data-writing stage, the low-level signal from the third pulse-width data-writing scanning-signal terminal PWM_DS3 conducts the third transistor M3, and after the data-writing stage is ended, the control signal from the third pulse-width data-writing scanning-signal terminal PWM_DS3 is boosted to be at a high level to cut off the third transistor M3, and the potential of the gate of the pulse-width drive transistor PWM_M0 is boosted through the feedthrough action of the feedthrough capacitor C0.

In another implementation, the third voltage terminal D3, the second pulse-width data-writing scanning-signal terminal PWM_DS2 are each electrically connected to the third pulse-width data-writing scanning-signal terminal PWM_DS3. An existing signal line in the pixel driving circuit is used for supplying the same electrical signal to the third voltage terminal D3, the second pulse-width data-writing scanning-signal terminal PWM_DS2 and the third pulse-width data-writing scanning-signal terminal PWM_DS3.

Figure 16:
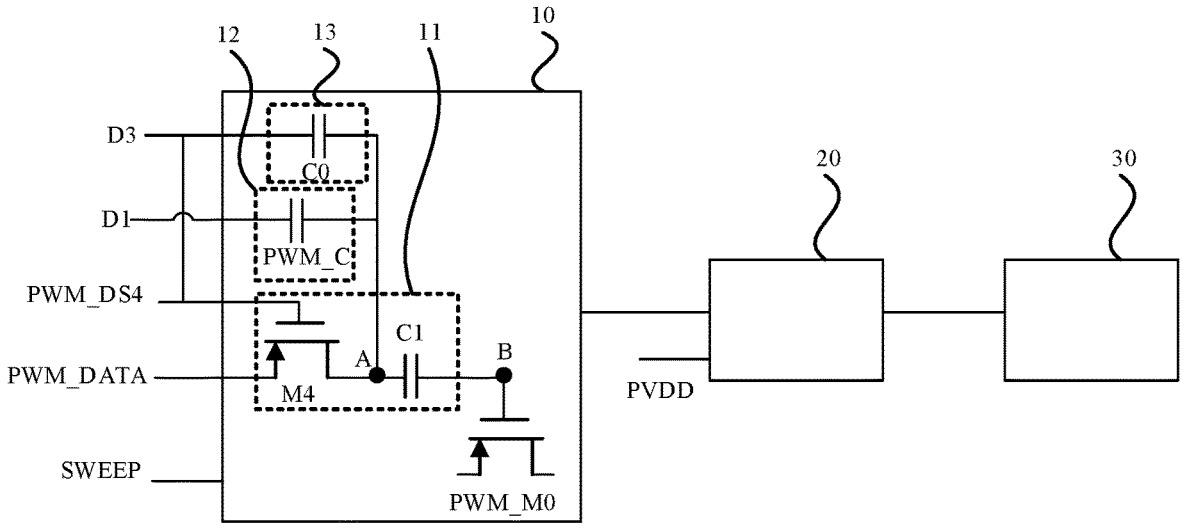
FIG. 16 is another schematic diagram of a pixel driving circuit according to embodiments of the present disclosure.

FIG. 16 is another schematic diagram of a pixel driving circuit according to embodiments of the present disclosure. Referring to FIG. 16, the pulse-width data-writing unit 11 includes the fourth transistor M4 and the first capacitor C1. The first terminal of the fourth transistor M4 is electrically connected to the pulse-width data signal terminal PWM_DATA, and the gate of the fourth transistor M4 is electrically connected to the fourth pulse-width data-writing scanning-signal terminal PWM_DS4. The first plate of the first capacitor C1 is electrically connected to the second terminal of the fourth transistor M4, and the second plate of the first capacitor C1 is electrically connected to the gate of the pulse-width drive transistor PWM_M0. The third voltage terminal D3 is electrically connected to the fourth pulse-width data-writing scanning-signal terminal PWM_DS4. An existing signal line in the pixel driving circuit is used for supplying the same electrical signal to the third voltage terminal D3 and the fourth pulse-width data-writing scanning-signal terminal PWM_DS4. In the present embodiments of the present disclosure, the fourth transistor M4 may be a P-type transistor. In the data-writing stage, the low-level signal from the fourth pulse-width data-writing scanning-signal terminal PWM_DS4 conducts the fourth transistor M4, and after the data-writing stage is ended, the control signal from the fourth pulse-width data-writing scanning-signal terminal PWM_DS4 is boosted to be at a high level to cut off the fourth transistor M4, and the potential of the gate of the pulse-width drive transistor PWM_M0 is boosted through the feedthrough action of the feedthrough capacitor C0.

Figure 17:
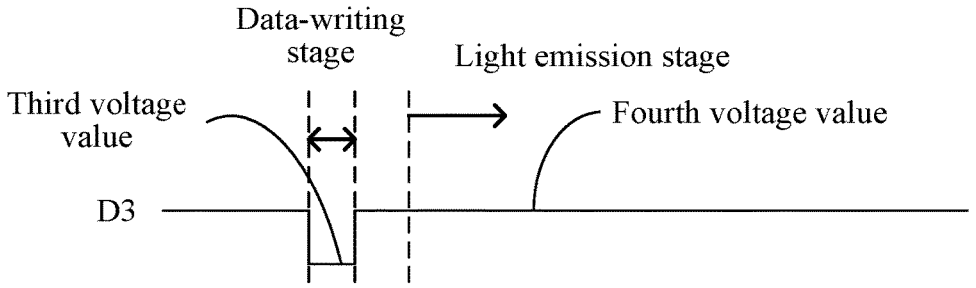
FIG. 17 is another schematic timing diagram of a pixel driving circuit according to embodiments of the present disclosure.

FIG. 17 is another schematic timing diagram of a pixel driving circuit according to embodiments of the present disclosure. Referring to FIGS. 14 and 17, in the data-writing stage, when the third voltage terminal D3 is configured to supply a voltage having the third voltage value, the first transistor M1 is conducted so that the pulse-width data signal is written into the gate of the pulse-width drive transistor PWM_M0. The voltage supplied from the third voltage terminal D3 is increased from the third voltage value to the fourth voltage value, so the first transistor M1 is cut off, the voltage of the first plate of the feedthrough capacitor C0 is increased from the third voltage value to the fourth voltage value, and the voltage of the second plate of the feedthrough capacitor C0 increases through the coupling action of the feedthrough capacitor C0, thereby boosting the voltage of the gate of the pulse-width drive transistor PWM_M0. Subsequently, in the light emission stage, a voltage having the fourth voltage value is supplied from the third voltage terminal D3, so the first transistor M1 is cut off, and the pulse-width storage capacitor PWM_C and the feedthrough capacitor C0 cooperatively hold the boosted potential of the gate of the pulse-width drive transistor PWM_M0. It is to be noted that the working principle of the feedthrough capacitor C0 in the pixel driving circuit of FIGS. 15 and 16 is similar to that in the preceding and is not repeated herein.

In some embodiments, referring to FIGS. 14 to 16, the pulse-width storage unit 12 includes the pulse-width storage capacitor PWM_C, and the data voltage boosting unit 13 includes the feedthrough capacitor C0. The feedthrough capacitor C0 has a capacitance smaller than the capacitance of the pulse-width storage capacitor PWM_C. The larger the capacitance of a capacitor is, the stronger the feedthrough capability of the capacitor is, and the smaller the capacitance of the capacitor is, the weaker the feedthrough capability of the capacitor is. The third voltage terminal D3 is electrically connected to the first pulse-width data-writing scanning-signal terminal PWM_DS1, the third pulse-width data-writing scanning-signal terminal PWM_DS3 or the fourth pulse-width data-writing scanning-signal terminal PWM_DS4, so the signals supplied to the first pulse-width data-writing scanning-signal terminal PWM_DS1, the third pulse-width data-writing scanning-signal terminal PWM_DS3 or the fourth pulse-width data-writing scanning-signal terminal PWM_DS4 are a high-level voltage vgh and a low-level voltage vgl, and the voltage difference between the high-level voltage vgh and the low-level voltage vgl is relatively large. In the present embodiments of the present disclosure, the capacitance of the feedthrough capacitor C0 is smaller than the capacitance of the pulse-width storage capacitor PWM_C, to control the increase amount of the voltage fed through to the gate of the pulse-width drive transistor PWM_M0, controlling the increase amount of the pulse-width data voltage and preventing the pulse-width data voltage from being increased excessively, and thus, the voltage value of the pulse-width data signal written into the gate of the pulse-width drive transistor PWM_M0 can be provided according to the existing data voltage range, and it is not necessarily to redesign the voltage value of the pulse-width data signal to be either a higher voltage value or a lower voltage value.

In another implementation, the capacitance of the feedthrough capacitor C0 may be smaller than half of the capacitance of the pulse-width storage capacitor PWM_C, to further reduce the increase amount of the voltage fed through to the gate of the pulse-width drive transistor PWM_M0 and prevent the pulse-width data voltage from being increased excessively.

In some embodiments, the pulse-width data signal is less than or equal to the sweep signal. That is, PWM_data≤sweep, where sweep denotes a sweep signal supplied from the frequency sweep terminal SWEEP. A process of boosting the voltage of the pulse-width data signal supplied to the gate of the pulse-width drive transistor PWM_M0 may be added in the pulse-width adjustment module 10. In this manner, the boosted voltage M0_VG of the gate of the pulse-width drive transistor PWM_M0 satisfies: SWEEP_MIN<M0_VG<SWEEP_MAX.

Further, a maximum value of the pulse-width data signal is less than or equal to the minimum value of the sweep signal: PWM_data<SWEEP_MIN. After the data voltage boosting unit 13 is provided in the pixel driving circuit, the data voltage boosting unit 13 is configured to boost the voltage of the gate of the pulse-width drive transistor PWM_M0, and a positive voltage difference ΔV is added on the basis of the original pulse-width data signal. In this case, SWEEP_MIN<(PWM_data+ΔV)<SWEEP_MAX, that is, M0_VG=PWM_data+ΔV. Therefore, the voltage value of the pulse-width data signal can be provided according to the existing data voltage range (for example, 0 V to 5 V) and is not necessarily to be greater than the minimum value of the sweep signal SWEEP_MIN.

Figure 18:
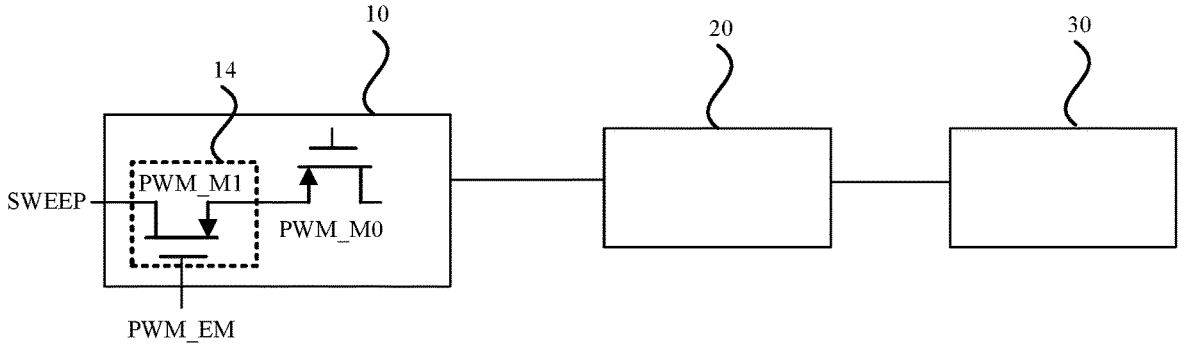
FIG. 18 is another schematic diagram of a pixel driving circuit according to embodiments of the present disclosure.

FIG. 18 is another schematic diagram of a pixel driving circuit according to embodiments of the present disclosure. Referring to FIG. 18, the pulse-width adjustment module 10 further includes a pulse-width adjustment unit 14. The pulse-width adjustment unit 14 includes a pulse-width adjustment transistor PWM_M1. The first terminal of the pulse-width adjustment transistor PWM_M1 is electrically connected to the sweep signal terminal SWEEP, the second terminal of the pulse-width adjustment transistor PWM_M1 is electrically connected to the first terminal of the pulse-width drive transistor PWM_M0, and the gate of the pulse-width adjustment transistor PWM_M1 is electrically connected to a pulse-width light emission signal terminal PWM_EM. In the light emission stage, when an enable signal input from the pulse-width light emission signal terminal PWM_EM conducts the pulse-width adjustment transistor PWM_M1, the sweep signal from the sweep signal terminal SWEEP is supplied to the first terminal of the pulse-width drive transistor PWM_M0. When the pulse-width drive transistor PWM_M0 is conducted, the sweep signal is supplied to the amplitude adjustment module 20 through the pulse-width drive transistor PWM_M0 and is used to switch off the amplitude adjustment module 20, and further to switch off the light-emitting element 30.

Figure 19:
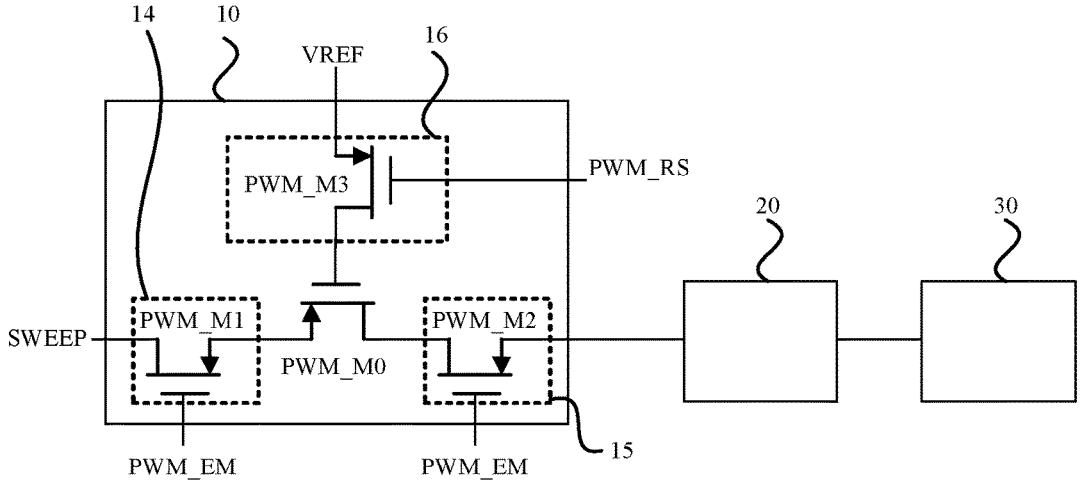
FIG. 19 is another schematic diagram of a pixel driving circuit according to embodiments of the present disclosure.

FIG. 19 is another schematic diagram of a pixel driving circuit according to embodiments of the present disclosure. Referring to FIG. 19, the pulse-width adjustment module 10 further includes a pulse-width light emission control unit 15 and a pulse-width reset unit 16. The pulse-width light emission control unit 15 includes a pulse-width light emission control transistor PWM_M2. The first terminal of the pulse-width light emission control transistor PWM_M2 is electrically connected to the second terminal of the pulse-width drive transistor PWM_M0, the second terminal of the pulse-width light emission control transistor PWM_M2 is electrically connected to the amplitude adjustment module 20, and the gate of the pulse-width light emission control transistor PWM_M2 is electrically connected to the pulse-width light emission signal terminal PWM_EM. In the light emission stage, when an enable signal input from the pulse-width light emission signal terminal PWM_EM conducts the pulse-width adjustment transistor PWM_M1 and the pulse-width light emission control transistor PWM_M2, the sweep signal from the sweep signal terminal SWEEP is supplied to the first terminal of the pulse-width drive transistor PWM_M0, and when the pulse-width drive transistor PWM_M0 is conducted, the sweep signal is supplied to the amplitude adjustment module 20 through the pulse-width drive transistor PWM_M0 and the pulse-width light emission control transistor PWM_M2.

In another implementation, the pulse-width light emission signal terminal connected to the gate of the pulse-width adjustment transistor PWM_M1 may be different from the pulse-width light emission signal terminal connected to the gate of the pulse-width light emission control transistor PWM_M2. That is, the pulse-width adjustment transistor PWM_M1 and the pulse-width light emission control transistor PWM_M2 are configured to receive different control signals.

The pulse-width reset unit 16 includes a pulse-width reset transistor PWM_M3. The first terminal of the pulse-width reset transistor PWM_M3 is electrically connected to a reference voltage terminal VREF, the second terminal of the pulse-width reset transistor PWM_M3 is electrically connected to the gate of the pulse-width drive transistor PWM_M0, and the gate of the pulse-width reset transistor PWM_M3 is electrically connected to a pulse-width reset scanning-signal terminal PWM_RS. The working process of the pixel driving circuit includes a reset stage, and the reset stage occurs before the data-writing stage. In the reset stage, when an enable signal input from the pulse-width reset scanning-signal terminal PWM_RS conducts the pulse-width reset transistor PWM_M3, a reference voltage from the reference voltage terminal VREF is supplied to the gate of the pulse-width drive transistor PWM_M0, thereby resetting the gate of the pulse-width drive transistor PWM_M0.

Figure 20:
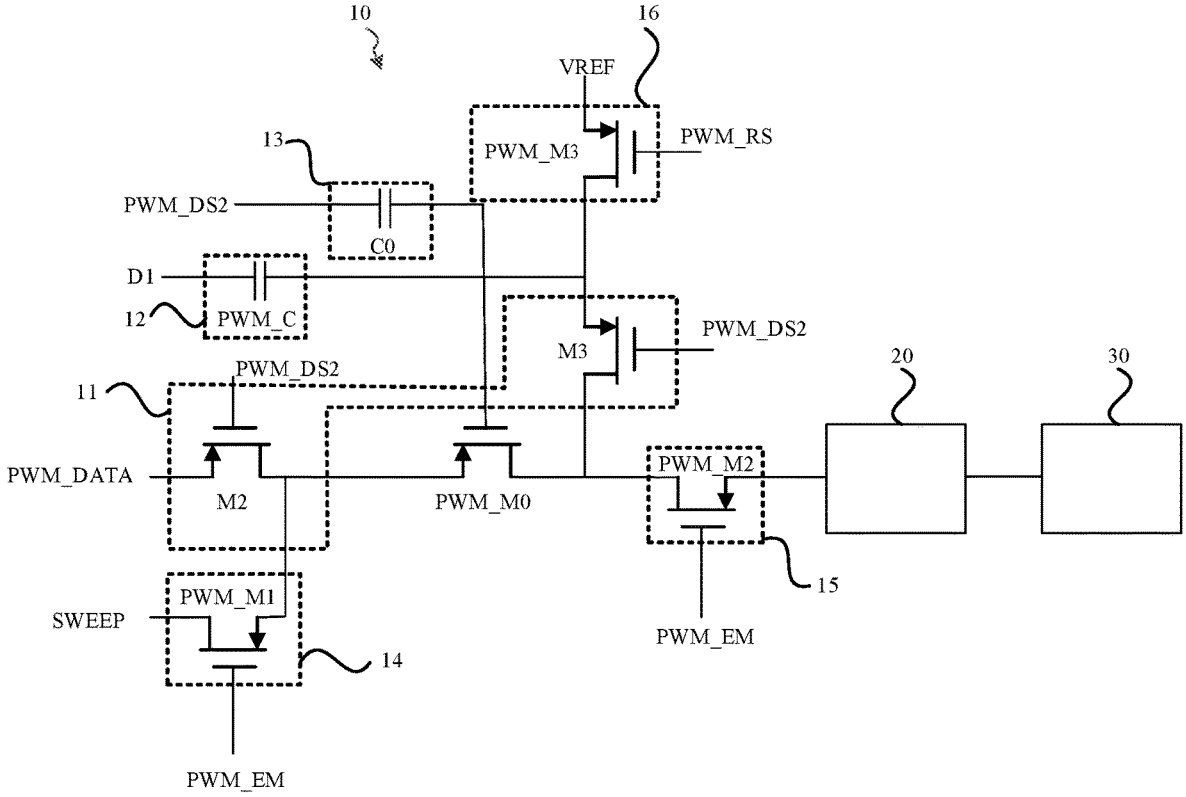
FIG. 20 is another schematic diagram of a pixel driving circuit according to embodiments of the present disclosure.
Figure 21:
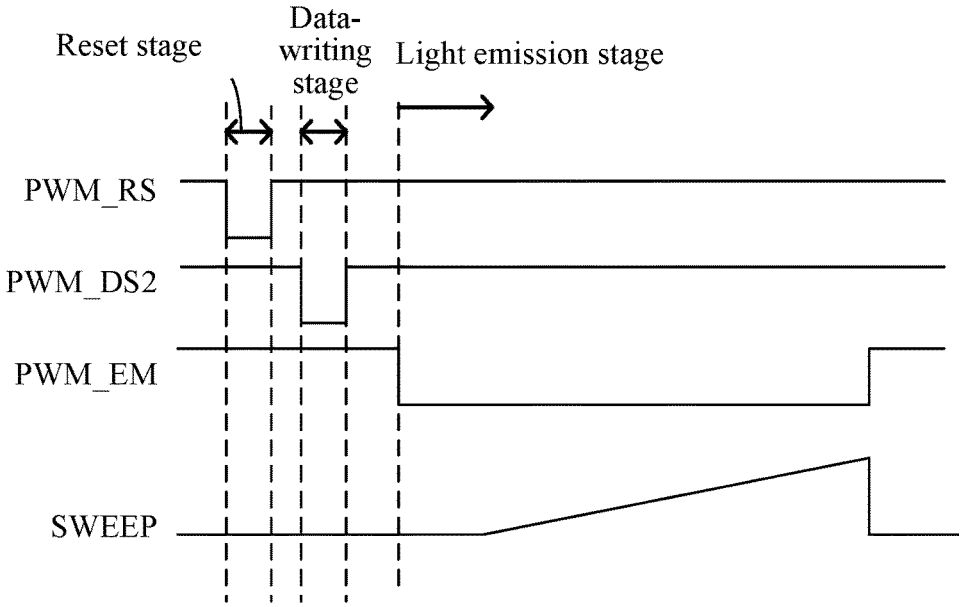
FIG. 21 is another schematic timing diagram of a pixel driving circuit according to embodiments of the present disclosure.

FIG. 20 is another schematic diagram of a pixel driving circuit according to embodiments of the present disclosure, and FIG. 21 is another schematic timing diagram of a pixel driving circuit according to embodiments of the present disclosure. Referring to FIGS. 20 and 21, the first plate of the feedthrough capacitor C0, the gate of the second transistor M2 and the gate of the third transistor M3 are each electrically connected to the second pulse-width data-writing scanning-signal terminal PWM_DS2 (that is, the third voltage terminal D3, the second pulse-width data-writing scanning-signal terminal PWM_DS2 and the third pulse-width data-writing scanning-signal terminal PWM_DS3 are electrically connected to each other). Each transistor in the pixel driving circuit is a P-type transistor.

In the reset stage, when the pulse-width reset scanning-signal terminal PWM_RS is at a low level, the pulse-width reset transistor PWM_M3 is conducted so that the reference voltage of the reference voltage terminal VREF is supplied to the gate of the pulse-width drive transistor PWM_M0, thereby resetting the gate of the pulse-width drive transistor PWM_M0. The second pulse-width data-writing scanning-signal terminal PWM_DS2 is at a high level, and the second transistor M2 and the third transistor M3 are cut off. The pulse-width light emission signal terminal PWM_EM is at a high level, the pulse-width adjustment transistor PWM_M1 and the pulse-width light emission control transistor PWM_M2 are cut off.

In the data-writing stage, when the pulse-width reset scanning-signal terminal PWM_RS is at a high level, the pulse-width reset transistor PWM_M3 is cut off. When the second pulse-width data-writing scanning-signal terminal PWM_DS2 is at a low level, the second transistor M2 and the third transistor M3 are conducted, and the pulse-width data signal from the pulse-width data signal terminal PWM_DATA is, in a manner of charging the pulse-width storage capacitor PWM_C, supplied to the gate of the pulse-width drive transistor PWM_M0 through the second transistor M2, the pulse-width drive transistor PWM_M0 and the third transistor M3. In this case, the voltage written into the gate of the pulse-width drive transistor PWM_M0 is the difference between the data voltage signal PWM_data and the threshold voltage Vth of the pulse-width drive transistor PWM_M0. When the pulse-width light emission signal terminal PWM_EM is at a high level, the pulse-width adjustment transistor PWM_M1 and the pulse-width light emission control transistor PWM_M2 are cut off. After the data-writing stage, the second pulse-width data-writing scanning-signal terminal PWM_DS2 is changed from the low level to a high level, and the boosted change in the voltage is fed through to the gate of the pulse-width drive transistor PWM_M0 through the coupling action of the feedthrough capacitor C0 to boost the voltage of the gate of the pulse-width drive transistor PWM_M0 to (PWM_data+ΔV−|VtH|). That is, M0_VG=PWM_data+ΔV−|Vth|. ΔV denotes a positive voltage difference boosted by the data voltage boosting unit 13. M0_VG denotes the boosted voltage of the gate of the pulse-width drive transistor PWM_M0.

In the light emission stage, when the pulse-width reset scanning-signal terminal PWM_RS is at a high level, the pulse-width reset transistor PWM_M3 is cut off. When the second pulse-width data-writing scanning-signal terminal PWM_DS2 is at a high level, the second transistor M2 and the third transistor M3 are cut off. When the pulse-width light emission signal terminal PWM_EM is at a low level, the pulse-width adjustment transistor PWM_M1 and the pulse-width light emission control transistor PWM_M2 are conducted, so that the sweep signal from the sweep signal terminal SWEEP is supplied to the first terminal of the pulse-width drive transistor PWM_M0 through the pulse-width adjustment transistor PWM_M1. The sweep signal includes a voltage value gradual variation duration. In the present embodiments in which the pulse-width drive transistor PWM_M0 is a P-type transistor, the voltage of the sweep signal increases linearly in the voltage value gradual variation duration. It is to be understood that the voltage of the sweep signal may increase nonlinearly as long as the voltage value of the sweep signal increases in the voltage value gradual variation duration. When the voltage value of the sweep signal is SWEEP_MIN, due to SWEEP_MIN<(PWM_data+ΔV−|Vth|)<SWEEP_MAX, the pulse-width drive transistor PWM_M0 is cut off. As the voltage value of the sweep signal increases until the voltage value of the sweep signal is slightly greater than (PWM_data+ΔV−|Vth|), that is, until the difference between the voltage value of the sweep signal and (PWM_data+ΔV−|Vth|) is greater than |Vth|, the pulse-width drive transistor PWM_M0 is conducted. The sweep signal is supplied to the amplitude adjustment module 20 through the pulse-width drive transistor PWM_M0 and the pulse-width light emission control transistor PWM_M2. The sweep signal switches off the amplitude adjustment module 20, thereby switching off the light-emitting element 30.

Figure 22:
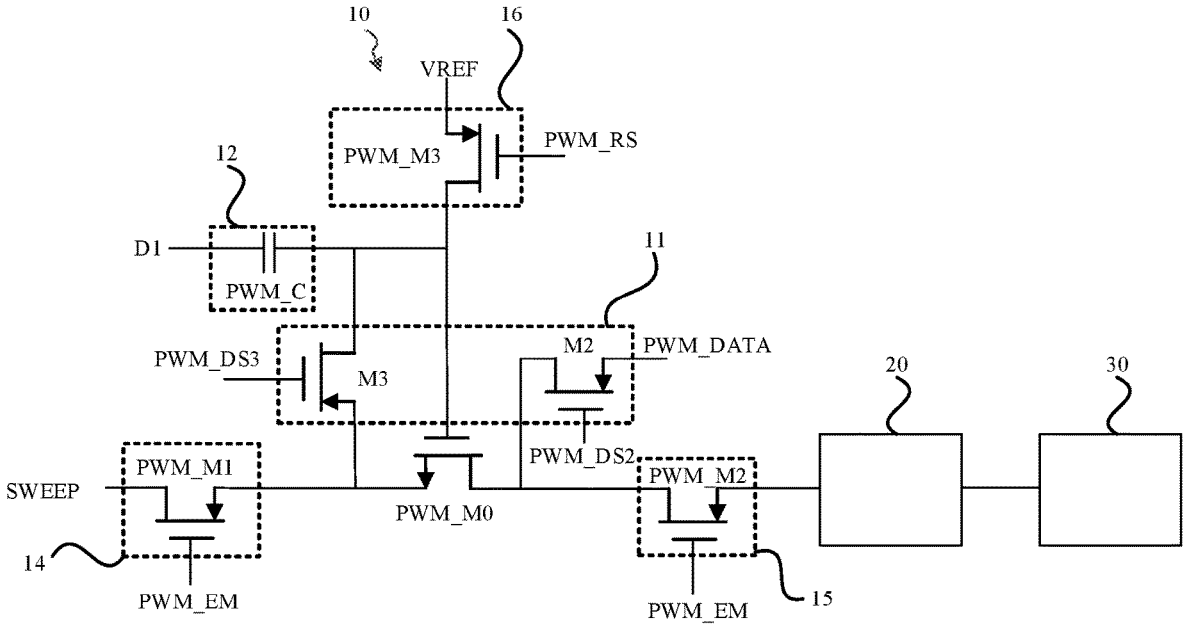
FIG. 22 is another schematic diagram of a pixel driving circuit according to embodiments of the present disclosure.
Figure 23:
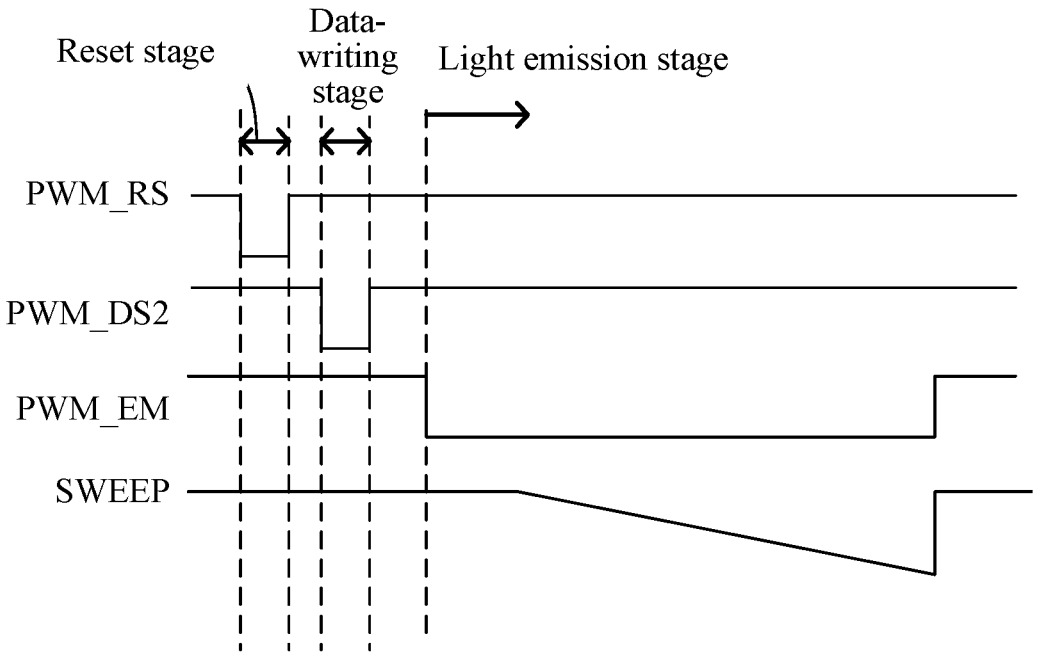
FIG. 23 is another schematic timing diagram of a pixel driving circuit according to embodiments of the present disclosure.

In one implementation, at least one transistor in the pixel driving circuit may be an N-type transistor. The pulse-width drive transistor PWM_M0 being an N-type transistor is taken as an example. FIG. 22 is another schematic diagram of a pixel driving circuit according to embodiments of the present disclosure, and FIG. 23 is another schematic timing diagram of a pixel driving circuit according to embodiments of the present disclosure. Referring to FIGS. 22 and 23, the pulse-width drive transistor PWM_M0 is an N-type transistor, and the voltage of the sweep signal may decrease linearly in the voltage value gradual variation duration. It is to be understood that the voltage of the sweep signal may decrease nonlinearly as long as the voltage value of the sweep signal decreases in the voltage value gradual variation duration. As the voltage value of the sweep signal decreases gradually until the voltage value of the sweep signal is slightly less than (PWM_data+ΔV+|Vth|), that is, until the difference between the voltage value of the sweep signal and (PWM_data+ΔV+|Vth|) is greater than |Vth|, the pulse-width drive transistor PWM_M0 is conducted. In this case, M0_VG=PWM_data+ΔV+|Vth|. The sweep signal is supplied to the amplitude adjustment module 20 through the pulse-width drive transistor PWM_M0 and the pulse-width light emission control transistor PWM_M2. The sweep signal switches off the amplitude adjustment module 20, thereby switching off the light-emitting element 30.

Figure 24:
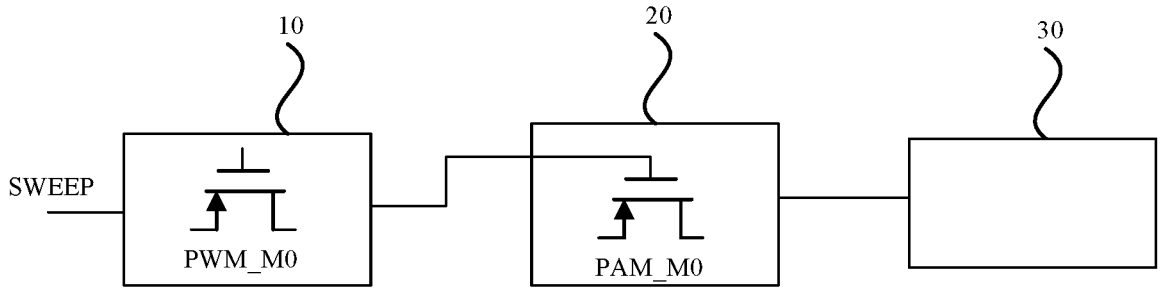
FIG. 24 is another schematic diagram of a pixel driving circuit according to embodiments of the present disclosure.

FIG. 24 is another schematic diagram of a pixel driving circuit according to embodiments of the present disclosure. Referring to FIG. 24, the amplitude adjustment module 20 includes an amplitude drive transistor PAM_M0. The amplitude drive transistor PAM_M0 is configured to supply a drive current to the light-emitting element 30 and drive the light-emitting element 30 to emit light. The pulse-width drive transistor PWM_M0 is configured to supply the sweep signal supplied from the sweep signal terminal SWEEP to the gate of the amplitude drive transistor PAM_M0. The sweep signal cuts off the amplitude drive transistor PAM_M0, so the amplitude drive transistor PAM_M0 does not supply the drive current to the light-emitting element 30, thereby switching off the amplitude adjustment module 20 and switching off the light-emitting element 30.

In an embodiment, the sweep signal is supplied to the gate of the amplitude drive transistor PAM_M0, the amplitude drive transistor PAM_M0 is a P-type transistor, and the voltage supplied to the first electrode of the amplitude drive transistor PAM_M0 is the first power voltage pvdd. When pvdd−sweep≤|Vth| is satisfied, the sweep signal cuts off the amplitude drive transistor PAM_M0. Therefore, the minimum voltage value SWEEP_MIN of the sweep signal (sweep) may be provided as: SWEEP_MIN>pvdd, so the sweep signal (sweep) of any voltage value supplied to the gate of the pulse-width drive transistor PWM_M0 cuts off the amplitude drive transistor PAM_M0.

In another embodiment, the sweep signal is supplied to the gate of the amplitude drive transistor PAM_M0, the amplitude drive transistor PAM_M0 is an N-type transistor, and the voltage supplied to the first electrode of the amplitude drive transistor PAM_M0 is the first power voltage pvdd. When sweep−pvdd≤|Vth| is satisfied, the sweep signal cuts off the amplitude drive transistor PAM_M0. Therefore, the maximum voltage value of the sweep signal (sweep) may be provided as: SWEEP_MAX≤pvdd+|Vth|, so the sweep signal (sweep) of any voltage value supplied to the gate of the pulse-width drive transistor PWM_M0 cuts off the amplitude drive transistor PAM_M0.

Figure 25:
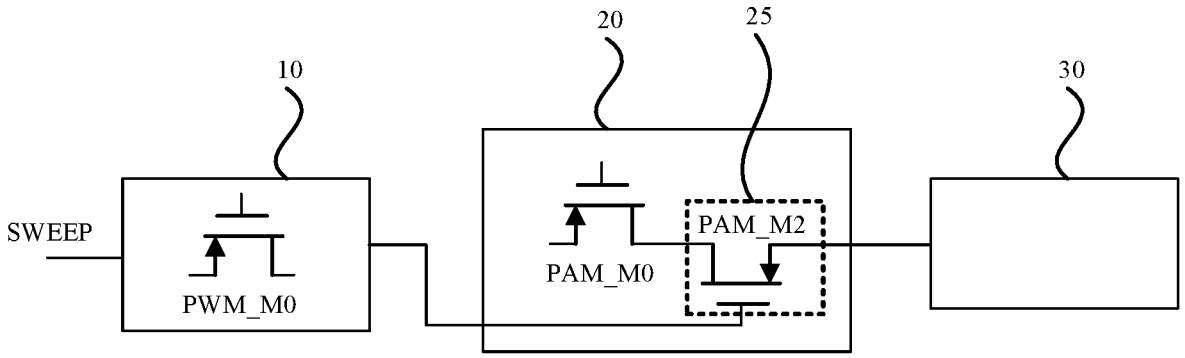
FIG. 25 is another schematic diagram of a pixel driving circuit according to embodiments of the present disclosure.

FIG. 25 is another schematic diagram of a pixel driving circuit according to embodiments of the present disclosure. Referring to FIG. 25, the amplitude adjustment module 20 includes the amplitude drive transistor PAM_M0 and an amplitude light emission control unit 25. The amplitude drive transistor PAM_M0 is configured to drive the light-emitting element 30. The amplitude light emission control unit 25 is configured to control conducting a driving path for the amplitude drive transistor PAM_M0 to drive the light-emitting element 30. The pulse-width drive transistor PWM_M0 is configured to supply the sweep signal supplied from the sweep signal terminal SWEEP to the control terminal of the amplitude light emission control unit 25. The sweep signal switches off the amplitude light emission control unit 25 so that the driving path for the pulse-width drive transistor PWM_M0 to drive the light-emitting element 30 is switched off, thereby achieving the purpose of switching off the light-emitting element 30.

Figure 26:
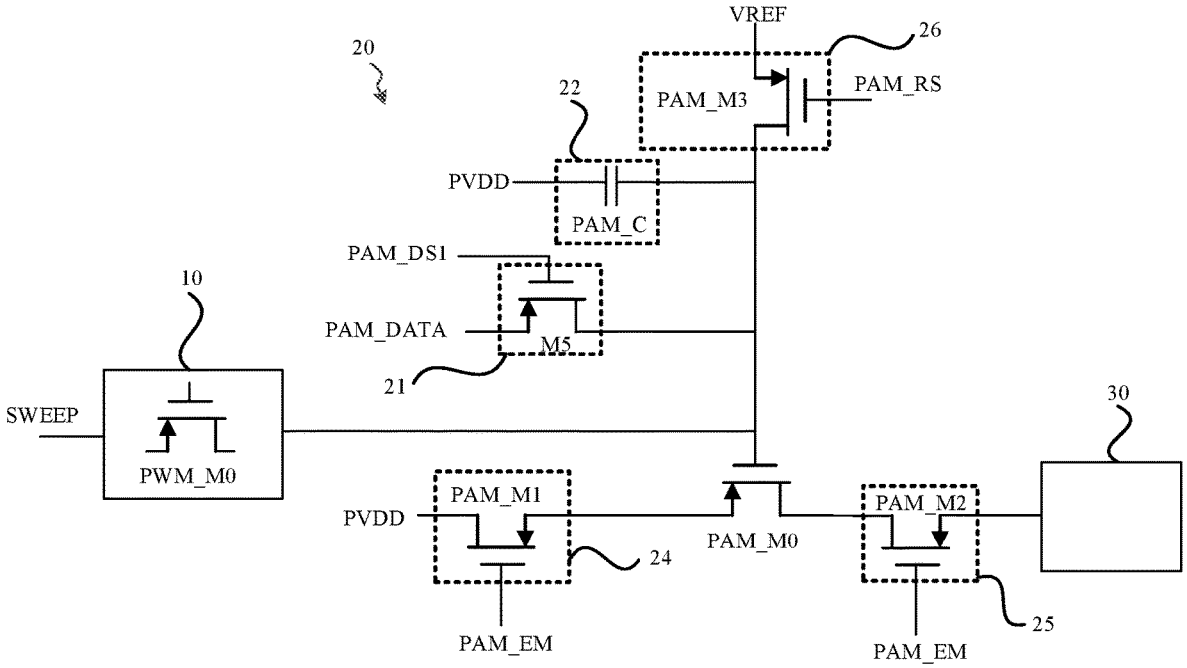
FIG. 26 is another schematic diagram of a pixel driving circuit according to embodiments of the present disclosure.

FIG. 26 is another schematic diagram of a pixel driving circuit according to embodiments of the present disclosure. Referring to FIG. 26, the amplitude adjustment module 20 includes the amplitude drive transistor PAM_M0, an amplitude data-writing unit 21, an amplitude storage unit 22, an amplitude adjustment unit 24, an amplitude light emission control unit 25 and an amplitude reset unit 26. The amplitude data-writing unit 21 includes a fifth transistor M5. The first terminal of the fifth transistor M5 is electrically connected to an amplitude data signal terminal PAM_DATA, the second terminal of the fifth transistor M5 is electrically connected to the gate of the amplitude drive transistor PAM_M0, and the gate of the fifth transistor M5 is electrically connected to a first amplitude data-writing scanning-signal terminal PAM_DS1. In the data-writing stage, when an enable signal from the first amplitude data-writing scanning-signal terminal PAM_DS1 conducts the fifth transistor M5, an amplitude data signal from the amplitude data signal terminal PAM_DATA is supplied to the gate of the amplitude drive transistor PAM_M0.

The amplitude storage unit 22 includes an amplitude storage capacitor PAM_C. The first plate of the amplitude storage capacitor PAM_C is electrically connected to the first power terminal PVDD, and the second plate of the amplitude storage capacitor PAM_C is electrically connected to the gate of the amplitude drive transistor PAM_M0. The amplitude data signal written into the gate of the amplitude drive transistor PAM_M0 in the data-writing stage is also written into the second plate of the amplitude storage capacitor PAM_C, so that the amplitude data signal is stored by the amplitude storage capacitor PAM_C.

The amplitude adjustment unit 24 includes an amplitude adjustment transistor PAM_M1. The first terminal of the amplitude adjustment transistor PAM_M1 is electrically connected to the first power terminal PVDD, the second terminal of the amplitude adjustment transistor PAM_M1 is electrically connected to the first terminal of the amplitude drive transistor PAM_M0, and the gate of the amplitude adjustment transistor PAM_M1 is electrically connected to an amplitude light emission signal terminal PAM_EM.

In the light emission stage, when an enable signal input from the amplitude light emission signal terminal PAM_EM conducts the amplitude adjustment transistor PAM_M1, the first power voltage of the first power terminal PVDD is supplied to the first terminal of the amplitude drive transistor PAM_M0. The amplitude drive transistor PAM_M0 being a P-type transistor is used as example. When the first power voltage of the first power terminal PVDD is greater than the amplitude data signal from the amplitude data signal terminal PAM_DATA, the amplitude drive transistor PAM_M0 is conducted, and the amplitude drive transistor PAM_M0 drives the light-emitting element 30 to emit light.

The amplitude light emission control unit 25 includes an amplitude light emission control transistor PAM_M2. The first terminal of the amplitude light emission control transistor PAM_M2 is electrically connected to the second terminal of the amplitude drive transistor PAM_M0, the second terminal of the amplitude light emission control transistor PAM_M2 is electrically connected to the light-emitting element 30, and the gate of the amplitude light emission control transistor PAM_M2 is electrically connected to the amplitude light emission signal terminal PAM_EM. In the light emission stage, when an enable signal input from the amplitude light emission signal terminal PAM_EM conducts the amplitude adjustment transistor PAM_M1 and the amplitude light emission control transistor PAM_M2, the first power voltage of the first power terminal PVDD is supplied to the first terminal of the amplitude drive transistor PAM_M0, thereby conducting the amplitude drive transistor PAM_M0, and the drive current generated by the amplitude drive transistor PAM_M0 drives the light-emitting element 30 to emit light. As shown in FIG. 26, in the present embodiments in which the sweep signal is applied to the gate of the amplitude drive transistor PAM_M0, when the sweep signal is applied to the gate of the amplitude drive transistor PAM_M0, the amplitude drive transistor PAM_M0 is changed from a conductive state to a cut-off state, and the light-emitting element 30 does not emit light. In other embodiments, the gate of the amplitude light emission control transistor PAM_M2 may also be electrically connected to the pulse-width adjustment module 10 and is configured to receive the sweep signal. When the sweep signal is applied to the gate of the amplitude light emission control transistor PAM_M2, the amplitude light emission control transistor PAM_M2 is changed from a conductive state to a cut-off state, which cuts off a flow path of the drive current, and makes the light-emitting element 30 not emit light.

The amplitude reset unit 26 includes an amplitude reset transistor PAM_M3. The first terminal of the amplitude reset transistor PAM_M3 is electrically connected to the reference voltage terminal VREF, the second terminal of the amplitude reset transistor PAM_M3 is electrically connected to the gate of the amplitude drive transistor PAM_M0, and the gate of the amplitude reset transistor PAM_M3 is electrically connected to an amplitude reset scanning-signal terminal PAM_RS. In the reset stage, when an enable signal input from the amplitude reset scanning-signal terminal PAM_RS conducts the amplitude reset transistor PAM_M3, the reference voltage of the reference voltage terminal VREF is supplied to the gate of the amplitude drive transistor PAM_M0, thereby resetting the gate of the amplitude drive transistor PAM_M0.

As an example, the sweep signal is supplied to the gate of the amplitude drive transistor PAM_M0, and the amplitude drive transistor PAM_M0 is a P-type transistor. An amplitude reference voltage (that is a reset voltage) applied to the gate of the amplitude drive transistor PAM_M0 is denoted as vref. The amplitude data signal supplied from the amplitude data signal terminal PAM_DATA is denoted as PAM_data. The reference voltage plays a role of reset, so the reference voltage needs to satisfy: vref<PAM_data. A P-type transistor is conducted by a low voltage, so the amplitude data signal PAM_data satisfies: PAM_data<pvdd.

Hereinafter, how the amplitude data signal is written into the amplitude drive transistor PAM_M0 by the amplitude data-writing unit 21 is illustrated as examples.

Figure 27:
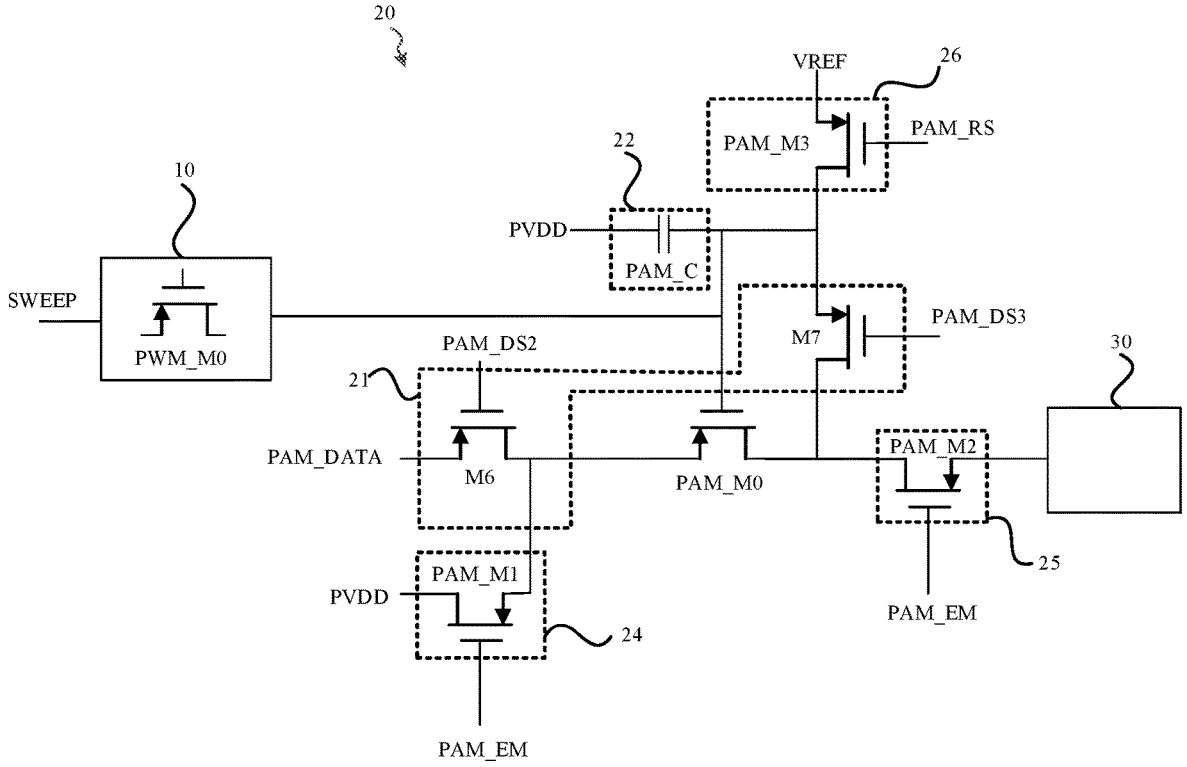
FIG. 27 is another schematic diagram of a pixel driving circuit according to embodiments of the present disclosure.

FIG. 27 is another schematic diagram of a pixel driving circuit according to embodiments of the present disclosure. Referring to FIG. 27, the amplitude data-writing unit 21 includes a sixth transistor M6 and a seventh transistor M7. The first terminal of the sixth transistor M6 is electrically connected to the amplitude data signal terminal PAM_DATA, the second terminal of the sixth transistor M6 is electrically connected to the first terminal of the amplitude drive transistor PAM_M0, and the gate of the sixth transistor M6 is electrically connected to a second amplitude data-writing scanning-signal terminal PAM_DS2. The first terminal of the seventh transistor M7 is electrically connected to the second terminal of the amplitude drive transistor PAM_M0, the second terminal of the seventh transistor M7 is electrically connected to the gate of the amplitude drive transistor PAM_M0, and the gate of the seventh transistor M7 is electrically connected to a third amplitude data-writing scanning-signal terminal PAM_DS3.

In one implementation, due to the electrical connection between the second amplitude data-writing scanning-signal terminal PAM_DS2 and the third amplitude data-writing scanning-signal terminal PAM_DS3, the same electrical signal is supplied to the second amplitude data-writing scanning-signal terminal PAM_DS2 and the third amplitude data-writing scanning-signal terminal PAM_DS3, thereby simultaneously controlling the sixth transistor M6 and the seventh transistor M7 to be conducted or to be cut off. In the data-writing stage, when an enable signal input from the second amplitude data-writing scanning-signal terminal PAM_DS2 conducts the sixth transistor M6, and an enable signal input from the third amplitude data-writing scanning-signal terminal PAM_DS3 conducts the seventh transistor M7, the amplitude data signal from the amplitude data signal terminal PAM_DATA is supplied to the gate of the amplitude drive transistor PAM_M0 through the sixth transistor M6, the amplitude drive transistor PAM_M0 and the seventh transistor M7. The seventh transistor M7 plays a role of compensating for the threshold voltage of the amplitude drive transistor PAM_M0.

In another implementation, the second amplitude data-writing scanning-signal terminal PAM_DS2 and the third amplitude data-writing scanning-signal terminal PAM_DS3 are configured to supply different electrical signals and respectively control the sixth transistor M6 and the seventh transistor M7 to be conducted or to be cut off.

Figure 28:
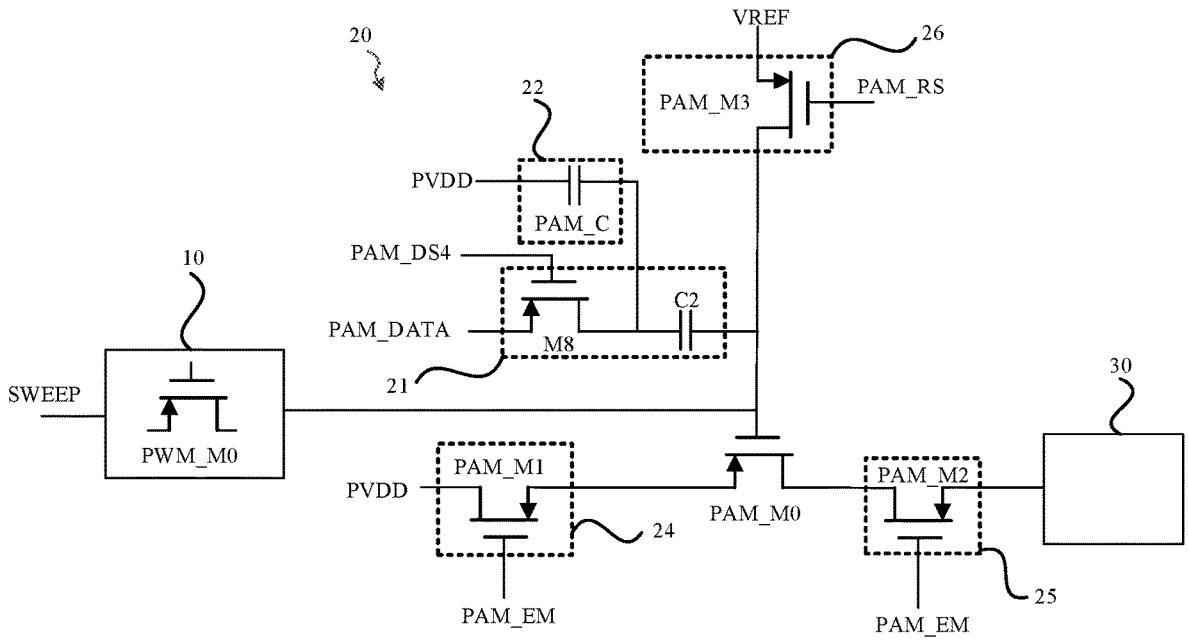
FIG. 28 is another schematic diagram of a pixel driving circuit according to embodiments of the present disclosure.

FIG. 28 is another schematic diagram of a pixel driving circuit according to embodiments of the present disclosure. Referring to FIG. 28, the amplitude data-writing unit 21 includes an eighth transistor M8 and a second capacitor C2. The first terminal of the eighth transistor M8 is electrically connected to the amplitude data signal terminal PAM_DATA, and the gate of the eighth transistor M8 is electrically connected to a fourth amplitude data-writing scanning-signal terminal PAM_DS4. The first plate of the second capacitor C2 is electrically connected to the second terminal of the eighth transistor M8, and the second plate of the second capacitor C2 is electrically connected to the gate of the amplitude drive transistor PAM_M0. In the data-writing stage, when an enable signal input from the fourth amplitude data-writing scanning-signal terminal PAM_DS4 conducts the eighth transistor M8, the amplitude data signal from the amplitude data signal terminal PAM_DATA is supplied to the first plate of the second capacitor C2 through the eighth transistor M8 and coupled to the second plate of the second capacitor C2 through the capacitive coupling action, so that the amplitude data signal is supplied to the gate of the amplitude drive transistor PAM_M0.

The pulse-width adjustment module 10 and the amplitude adjustment module 20 each include a port for supplying a data signal, a port for supplying a scan control signal and a port for supplying a constant voltage. Some ports in the pulse-width adjustment module 10 may also serves as some ports of the amplitude adjustment module 20, so that the sharing of ports can be implemented, thereby reducing the number of signal lines used.

Figure 29:
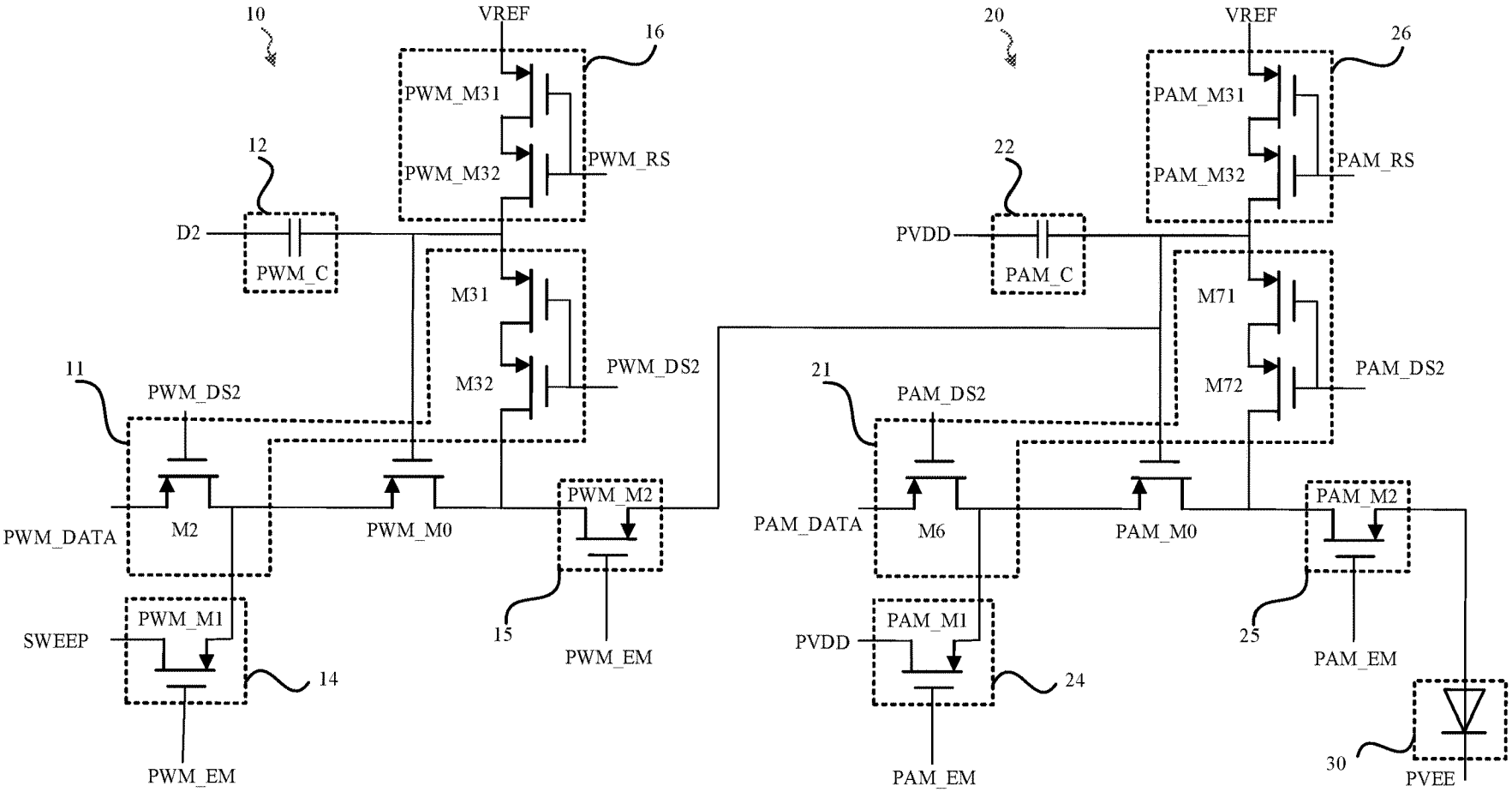
FIG. 29 is another schematic diagram of a pixel driving circuit according to embodiments of the present disclosure.
Figure 30:
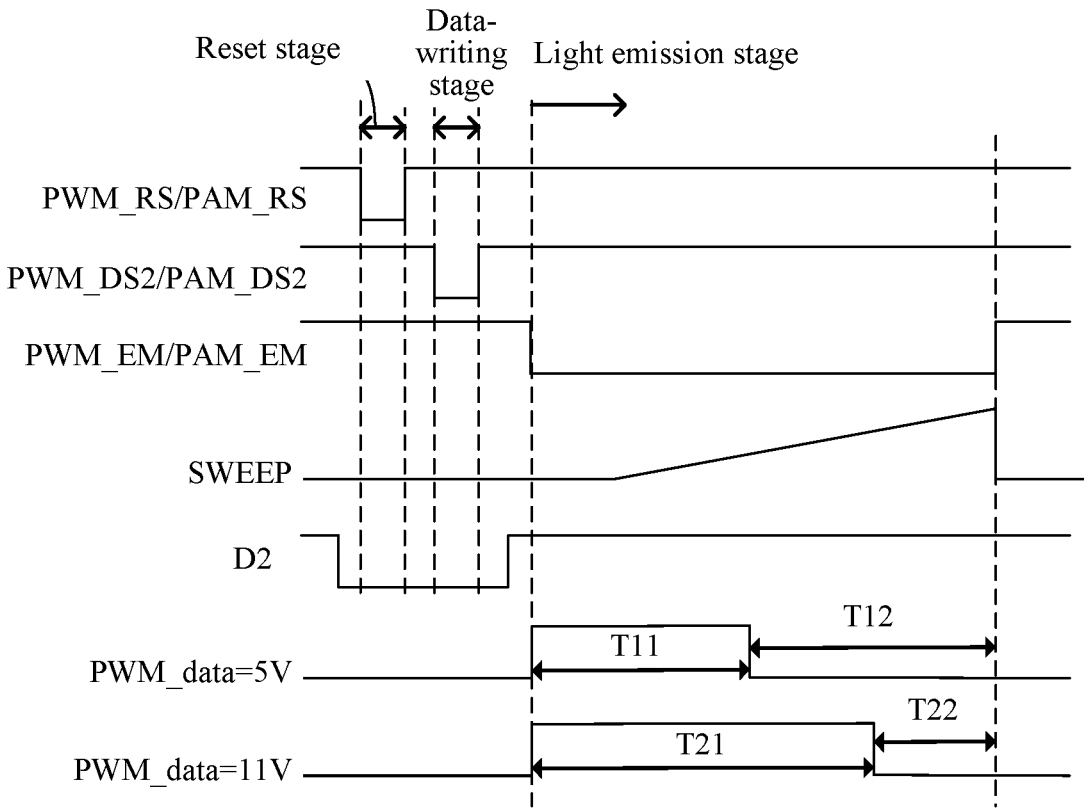
FIG. 30 is another schematic timing diagram of a pixel driving circuit according to embodiments of the present disclosure.

FIG. 29 is another schematic diagram of a pixel driving circuit according to embodiments of the present disclosure, and FIG. 30 is another schematic timing diagram of a pixel driving circuit according to embodiments of the present disclosure. Referring to FIGS. 29 and 30, the pulse-width reset scanning-signal terminal PWM_RS and the amplitude reset scanning-signal terminal PAM_RS are configured to supply a same electrical signal, the second pulse-width data-writing scanning-signal terminal PWM_DS2 and the second amplitude data-writing scanning-signal terminal PAM_DS2 are configured to supply a same electrical signal, and the pulse-width light emission signal terminal PWM_EM and the amplitude light emission signal terminal PAM_EM are configured to supply a same electrical signal. In such arrangements, the ports therefor are multiplexed, thereby reducing the number of signal lines used. Moreover, in the reset stage, the gate of the pulse-width drive transistor PWM_M0 and the gate of the amplitude drive transistor PAM_M0 are reset simultaneously. In the data-writing stage, the pulse-width data signal is written into the gate of the pulse-width drive transistor PWM_M0, and in the meanwhile, the amplitude data signal is written into the gate of the amplitude drive transistor PAM_M0. Similarly, in other embodiments, the first pulse-width data-writing scanning-signal terminal PWM_DS1 and the first amplitude data-writing scanning-signal terminal PAM_DS1 are configured to supply the same electrical signal, the third pulse-width data-writing scanning-signal terminal PWM_DS3 and the third amplitude data-writing scanning-signal terminal PAM_DS3 are configured to supply the same electrical signal, and the fourth pulse-width data-writing scanning-signal terminal PWM_DS4 and the fourth amplitude data-writing scanning-signal terminal PAM_DS4 are configured to supply the same electrical signal.

In one implementation, the data voltage boosting unit 13 is provided in the pixel driving circuit, the voltage value of the pulse-width data signal may be provided according to the existing data voltage range, and the pulse-width data signal terminal PWM_DATA and the amplitude data signal terminal PAM_DATA are configured to supply the same electrical signal. That is, the pulse-width data signal is the same as the amplitude data signal.

Figure 31:
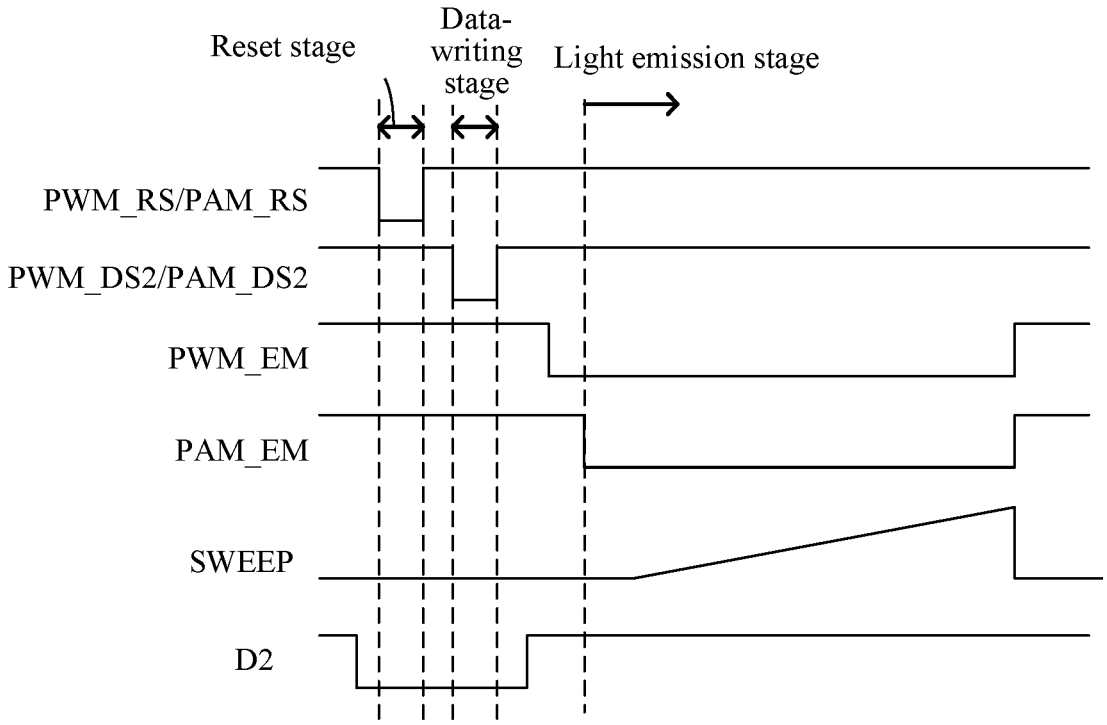
FIG. 31 is another schematic timing diagram of a pixel driving circuit according to embodiments of the present disclosure.

FIG. 31 is another schematic timing diagram of a pixel driving circuit according to embodiments of the present disclosure. Referring to FIGS. 29 and 31, the pulse-width light emission signal terminal PWM_EM and the amplitude light emission signal terminal PAM_EM are configured to supply different electrical signals, the enable signal from the pulse-width light emission signal terminal PWM_EM is supplied ahead of the enable signal from the amplitude light emission signal terminal PAM_EM, and a signal falling edge of the pulse-width light emission signal terminal PWM_EM appears ahead of the signal falling edge of the amplitude light emission signal terminal PAM_EM. Such arrangements lie in that time is needed for the voltage supplied to the gate of the amplitude drive transistor PAM_M0 to change, the enable signal from the pulse-width light emission signal terminal PWM_EM provided ahead of the enable signal from the amplitude light emission signal terminal PAM_EM may reserve the time for the voltage of the gate of the amplitude drive transistor PAM_M0 to change, and when the enable signal from the amplitude light emission signal terminal PAM_EM is supplied, the amplitude drive transistor PAM_M0 may immediately response thereto, to improve the contrast ratio of a display panel.

In other implementations, the pulse-width reset scanning-signal terminal PWM_RS and the amplitude reset scanning-signal terminal PAM_RS may also be configured to supply different electrical signals. The stage of resetting the gate of the pulse-width drive transistor PWM_M0 is referred as the pulse-width reset stage. The stage of resetting the gate of the amplitude drive transistor PAM_M0 is referred as the amplitude reset stage. The reset stage includes the pulse-width reset stage and the amplitude reset stage. The pulse-width reset stage and the amplitude reset stage may no longer coincide.

In other embodiments, the second pulse-width data-writing scanning-signal terminal PWM_DS2 and the second amplitude data-writing scanning-signal terminal PAM_DS2 are configured to supply different electrical signals. The stage of writing the pulse-width data signal into the gate of the pulse-width drive transistor PWM_M0 is referred as the pulse-width data-writing stage. The stage of writing the amplitude data signal into the gate of the amplitude drive transistor PAM_M0 is referred as the amplitude data-writing stage. The data-writing stage includes the pulse-width data-writing stage and the amplitude data-writing stage. The pulse-width data-writing stage and the amplitude data-writing stage may no longer coincide.

As an example, referring to FIG. 29, the second terminal of the light-emitting element 30 is electrically connected to the second power terminal PVEE. The light-emitting element 30 may be a light-emitting diode, for example, an organic light-emitting diode or an inorganic light-emitting diode. The inorganic light-emitting diode may be a micro light-emitting diode (i.e., μLED). The micro light-emitting diode has advantages such as a smaller size, a faster response speed, higher light emission efficiency, stronger stability and a longer service life.

In one implementation, referring to FIG. 18, the pixel driving circuit includes a pulse-width adjustment module 10, an amplitude adjustment module 20 and a light-emitting element 30. The pulse-width adjustment module 10 includes the pulse-width drive transistor PWM_M0 and the pulse-width adjustment unit 14. The control terminal of the pulse-width adjustment unit 14 is electrically connected to the pulse-width light emission signal terminal PWM_EM, the first terminal of the pulse-width adjustment unit 14 is electrically connected to the sweep signal terminal SWEEP, and the second terminal of the pulse-width adjustment unit 14 is electrically connected to the first terminal of the pulse-width drive transistor PWM_M0. The input terminal of the amplitude adjustment module 20 is electrically connected to the output terminal of the pulse-width adjustment module 10, and the output terminal of the amplitude adjustment module 20 is electrically connected to the light-emitting element 30. In the pixel driving circuit provided by the present embodiments of the present disclosure, in the light emission stage, when the enable signal input from the pulse-width light emission signal terminal PWM_EM conducts the pulse-width adjustment transistor PWM_M1, the sweep signal from the sweep signal terminal SWEEP is supplied to the first terminal of the pulse-width drive transistor PWM_M0. When the pulse-width drive transistor PWM_M0 is conducted, the sweep signal is supplied to the amplitude adjustment module 20 through the pulse-width drive transistor PWM_M0 and the sweep signal is used for switching off the amplitude adjustment module 20, and further switching off the light-emitting element 30.

Embodiments of the present disclosure provide a driving method of a pixel driving circuit. FIG. 32 is a schematic flowchart of a driving method of a pixel driving circuit according to embodiments of the present disclosure. Referring to FIG. 1, the pixel driving circuit includes the pulse-width adjustment module 10, the amplitude adjustment module 20 and the light-emitting element 30. The pulse-width adjustment module 10 is electrically connected to the sweep signal terminal SWEEP and includes the pulse-width drive transistor PWM_M0. A working process of the pixel driving circuit includes a light emission stage. As shown in FIG. 32, the driving method of a pixel driving circuit includes that: in S3210, in the light emission stage, the pulse-width drive transistor PWM_M0 supplies the sweep signal supplied from the sweep signal terminal SWEEP to the amplitude adjustment module 20, and the amplitude adjustment module 20 control a light emission duration of the light-emitting element 30 according to the sweep signal.

Compared with the related art, in the driving method of a pixel driving circuit provided by the present embodiments of the present disclosure, the pulse-width drive transistor PWM_M0 is configured to supply the sweep signal supplied from the sweep signal terminal SWEEP to the amplitude adjustment module 20, and the sweep signal controls the light emission duration of the light-emitting element 30 so that a switching-off voltage does not need to be provided additionally to switch off the amplitude adjustment module 20. That is, the present embodiments of the present disclosure uses a sweep signal instead of a switching-off voltage to switch off the amplitude adjustment module 20 so that the light-emitting element 30 is switched off and will not emit light. Therefore, in the driving method of a pixel driving circuit provided by the present embodiments of the present disclosure, a switching-off voltage for switching off the amplitude adjustment module 20 does not need to be supplied additionally, thereby reducing the circuit complexity of the pixel driving circuit.

As an example, referring to FIGS. 29 and 30, the sweep signal is supplied to the gate of the amplitude drive transistor PAM_M0, and the amplitude drive transistor PAM_M0 is a P-type transistor. The light emission stage includes a light emission duration and a non-light emission duration. In the light emission duration, the light-emitting element 30 emits light; and in the non-light emission duration, the light-emitting element 30 is switched off due to that the frequency sweep voltage is applied to the gate of the amplitude drive transistor PAM_M0. Taking PWM_data=5 V as an example, the light emission stage includes a first light emission duration T11 and a first non-light emission duration T12. Taking PWM_data=11 V as an example, the light emission stage includes a second light emission duration T21 and a second non-light emission duration T22. T11<T12, that is, the greater the voltage value of the supplied pulse-width data signal PWM_data is, the longer the light emission duration is; the smaller the voltage value of the supplied pulse-width data signal PWM_data is, the shorter the light emission duration is.

In conjunction with FIGS. 10 to 12, the pulse-width storage unit 12 includes the pulse-width storage capacitor PWM_C. The first plate of the pulse-width storage capacitor PWM_C is electrically connected to the second voltage terminal D2. The voltages supplied from the second voltage terminal D2 include the first voltage value and the second voltage value that are different from each other. The working process of the pixel driving circuit further includes a data-writing stage. The driving method of a pixel driving circuit includes that a voltage having the first voltage value is supplied from the second voltage terminal D2 in the data-writing stage; and a voltage having the second voltage value is supplied from the second voltage terminal D2 in the light emission stage. In the present embodiments of the present disclosure, the voltage of the second voltage terminal D2 changes, and the voltage of the second plate of the pulse-width storage capacitor PWM_C is increased through a coupling action of the pulse-width storage capacitor PWM_C, thereby boosting the voltage of the gate of the pulse-width drive transistor PWM_M0.

In some embodiments, referring to FIGS. 13 to 17, the pulse-width adjustment module 10 further includes the pulse-width storage capacitor PWM_C and the feedthrough capacitor C0. The pulse-width storage capacitor PWM_C is configured to store the pulse-width data signal. The feedthrough capacitor C0 is configured to boost the pulse-width data signal stored in the pulse-width storage capacitor PWM_C. The first plate of the feedthrough capacitor C0 is electrically connected to the third voltage terminal D3. The voltages supplied from the third voltage terminal D3 include the third voltage value and the fourth voltage value that are different from each other. The working process of the pixel driving circuit further includes a data-writing stage. The driving method of a pixel driving circuit includes that, a voltage having the third voltage value is supplied from the third voltage terminal D3 in the data-writing stage; and a voltage having the fourth voltage value is supplied from the third voltage terminal D3 in the light emission stage. In the present embodiments of this present disclosure, the voltage change of the third voltage terminal D3 is fed through to the gate of the pulse-width drive transistor PWM_M0 through the coupling action of the feedthrough capacitor C0 to boost the voltage of the gate of the pulse-width drive transistor PWM_M0.

Embodiments of the present disclosure further provide a display panel. FIG. 33 is a schematic diagram of a display panel according to embodiments of the present disclosure. As shown in FIG. 33, the display panel including the pixel driving circuit 1 according to any embodiment of the present disclosure.

Embodiments of the present disclosure further provide a display device. FIG. 34 is a schematic diagram of a display device according to embodiments of the present disclosure. As shown in FIG. 34, the display device includes the display panel 2 according to any embodiment of the present disclosure. The display device may be any device having a display function, such as a computer, a cellphone, a tablet computer, or the like.

It is to be noted that the preceding are only preferred embodiments of the present disclosure and technical principles used therein. It is to be understood by those skilled in the art that the present disclosure is not limited to the embodiments described herein. Those skilled in the art can make various apparent modifications, adaptations, combinations and substitutions without departing from the scope of the present disclosure. Therefore, while the present disclosure has been described in detail through the preceding embodiments, the present disclosure is not limited to the preceding embodiments and may include more other equivalent embodiments without departing from the concept of the present disclosure. The scope of the present disclosure is determined according to the scope of the appended claims.

What is claimed is:

1. A pixel driving circuit, comprising: a pulse-width adjustment module, an amplitude adjustment module and a light-emitting element, wherein the pulse-width adjustment module is electrically connected to a sweep signal terminal and comprises a pulse-width drive transistor, and the pulse-width drive transistor is configured to supply a sweep signal supplied from the sweep signal terminal to the amplitude adjustment module;

wherein the amplitude adjustment module is configured to control a light emission duration of the light-emitting element according to the sweep signal;

wherein the pulse-width adjustment module further comprises a pulse-width data-writing unit, and the pulse-width data-writing unit is configured to supply a pulse-width data signal to a gate of the pulse-width drive transistor; and wherein the pulse-width adjustment module further comprises a pulse-width storage unit, and the pulse-width storage unit is configured to store the pulse-width data signal.

2. The pixel driving circuit according to claim 1, wherein the pulse-width data-writing unit comprises a first transistor, and wherein a first terminal of the first transistor is electrically connected to a pulse-width data signal terminal, a second terminal of the first transistor is electrically connected to the gate of the pulse-width drive transistor, and a gate of the first transistor is electrically connected to a first pulse-width data-writing scanning-signal terminal;

or, wherein the pulse-width data-writing unit comprises:

a second transistor, wherein a first terminal of the second transistor is electrically connected to a pulse-width data signal terminal, a second terminal of the second transistor is electrically connected to a first terminal of the pulse-width drive transistor, and a gate of the second transistor is electrically connected to a second pulse-width data-writing scanning-signal terminal; and a third transistor, wherein a first terminal of the third transistor is electrically connected to a second terminal of the pulse-width drive transistor, a second terminal of the third transistor is electrically connected to the gate of the pulse-width drive transistor, and a gate of the third transistor is electrically connected to a third pulse-width data-writing scanning-signal terminal;

or, wherein the pulse-width data-writing unit comprises:

a fourth transistor, wherein a first terminal of the fourth transistor is electrically connected to a pulse-width data signal terminal, and a gate of the fourth transistor is electrically connected to a fourth pulse-width data-writing scanning-signal terminal; and a first capacitor, wherein a first plate of the first capacitor is electrically connected to a second terminal of the fourth transistor, and a second plate of the first capacitor is electrically connected to the gate of the pulse-width drive transistor.

3. The pixel driving circuit according to claim 1, wherein the pulse-width storage unit comprises a pulse-width storage capacitor, and a first plate of the pulse-width storage capacitor is electrically connected to a first voltage terminal;

wherein the first voltage terminal is configured to supply a constant voltage;

wherein the amplitude adjustment module is electrically connected to a first power terminal; and wherein the first voltage terminal is electrically connected to the first power terminal.

4. The pixel driving circuit according to claim 1, wherein the pulse-width storage unit comprises a pulse-width storage capacitor, and a first plate of the pulse-width storage capacitor is electrically connected to a second voltage terminal; and wherein voltages supplied from the second voltage terminal comprise a first voltage value and a second voltage value that are different from each other.

5. The pixel driving circuit according to claim 1, wherein the pulse-width adjustment module further comprises a data voltage boosting unit, and the data voltage boosting unit is configured to boost the pulse-width data signal stored in the pulse-width storage unit.

6. The pixel driving circuit according to claim 5, wherein the data voltage boosting unit comprises a feedthrough capacitor, and a first plate of the feedthrough capacitor is electrically connected to a third voltage terminal; and wherein voltages supplied from the third voltage terminal comprise a third voltage value and a fourth voltage value that are different from each other.

7. The pixel driving circuit according to claim 6, wherein:

the pulse-width data-writing unit comprises a first transistor, wherein a first terminal of the first transistor is electrically connected to a pulse-width data signal terminal, a second terminal of the first transistor is electrically connected to the gate of the pulse-width drive transistor, a gate of the first transistor is electrically connected to a first pulse-width data-writing scanning-signal terminal, and the third voltage terminal is electrically connected to the first pulse-width data-writing scanning-signal terminal; or the pulse-width data-writing unit comprises a second transistor and a third transistor, wherein a first terminal of the second transistor is electrically connected to the pulse-width data signal terminal, a second terminal of the second transistor is electrically connected to a first terminal of the pulse-width drive transistor, a gate of the second transistor is electrically connected to a second pulse-width data-writing scanning-signal terminal, a first terminal of the third transistor is electrically connected to a second terminal of the pulse-width drive transistor, a second terminal of the third transistor is electrically connected to the gate of the pulse-width drive transistor, a gate of the third transistor is electrically connected to a third pulse-width data-writing scanning-signal terminal, and the third voltage terminal is electrically connected to the third pulse-width data-writing scanning-signal terminal; or the pulse-width data-writing unit comprises a fourth transistor and a first capacitor, wherein a first terminal of the fourth transistor is electrically connected to the pulse-width data signal terminal, a gate of the fourth transistor is electrically connected to a fourth pulse-width data-writing scanning-signal terminal, a first plate of the first capacitor is electrically connected to a second terminal of the fourth transistor, a second plate of the first capacitor is electrically connected to the gate of the pulse-width drive transistor, and the third voltage terminal is electrically connected to the fourth pulse-width data-writing scanning-signal terminal.

8. The pixel driving circuit according to claim 5, wherein the pulse-width storage unit comprises a pulse-width storage capacitor, the data voltage boosting unit comprises a feedthrough capacitor, and a capacitance of the feedthrough capacitor is smaller than a capacitance of the pulse-width storage capacitor.

9. The pixel driving circuit according to claim 1, wherein the pulse-width data signal is less than or equal to the sweep signal.

10. The pixel driving circuit according to claim 1, wherein the pulse-width adjustment module further comprises a pulse-width adjustment unit, the pulse-width adjustment unit comprises a pulse-width adjustment transistor, wherein a first terminal of the pulse-width adjustment transistor is electrically connected to the sweep signal terminal, a second terminal of the pulse-width adjustment transistor is electrically connected to a first terminal of the pulse-width drive transistor, and a gate of the pulse-width adjustment transistor is electrically connected to a pulse-width light emission signal terminal; and wherein the pulse-width adjustment module further comprises a pulse-width light emission control unit and a pulse-width reset unit;

the pulse-width light emission control unit comprises a pulse-width light emission control transistor, wherein a first terminal of the pulse-width light emission control transistor is electrically connected to a second terminal of the pulse-width drive transistor, a second terminal of the pulse-width light emission control transistor is electrically connected to the amplitude adjustment module, and a gate of the pulse-width light emission control transistor is electrically connected to the pulse-width light emission signal terminal; and the pulse-width reset unit comprises a pulse-width reset transistor, wherein a first terminal of the pulse-width reset transistor is electrically connected to a reference voltage terminal, a second terminal of the pulse-width reset transistor is electrically connected to a gate of the pulse-width drive transistor, and a gate of the pulse-width reset transistor is electrically connected to a pulse-width reset scanning-signal terminal.

11. The pixel driving circuit according to claim 1, wherein the amplitude adjustment module comprises an amplitude drive transistor, the amplitude drive transistor is configured to drive the light-emitting element; and the pulse-width drive transistor is configured to supply the sweep signal supplied from the sweep signal terminal to a gate of the amplitude drive transistor;

or, wherein the amplitude adjustment module comprises an amplitude drive transistor and an amplitude light emission control unit;

the amplitude drive transistor is configured to drive the light-emitting element;

the amplitude light emission control unit is configured to control conducting a driving path for the amplitude drive transistor to drive the light-emitting element; and the pulse-width drive transistor is configured to supply the sweep signal supplied from the sweep signal terminal to a control terminal of the amplitude light emission control unit.

12. The pixel driving circuit according to claim 1, wherein the amplitude adjustment module comprises an amplitude drive transistor, an amplitude data-writing unit, an amplitude storage unit, an amplitude adjustment unit, an amplitude light emission control unit and an amplitude reset unit, wherein the amplitude data-writing unit comprises one of the following:

a fifth transistor, wherein a first terminal of the fifth transistor is electrically connected to an amplitude data signal terminal, a second terminal of the fifth transistor is electrically connected to a gate of the amplitude drive transistor, and a gate of the fifth transistor is electrically connected to a first amplitude data-writing scanning-signal terminal;

a sixth transistor and a seventh transistor, wherein a first terminal of the sixth transistor is electrically connected to the amplitude data signal terminal, a second terminal of the sixth transistor is electrically connected to a first terminal of the amplitude drive transistor, and a gate of the sixth transistor is electrically connected to a second amplitude data-writing scanning-signal terminal, and wherein a first terminal of the seventh transistor is electrically connected to a second terminal of the amplitude drive transistor, a second terminal of the seventh transistor is electrically connected to the gate of the amplitude drive transistor, and a gate of the seventh transistor is electrically connected to a third amplitude data-writing scanning-signal terminal; or, an eighth transistor and a second capacitor, wherein a first terminal of the eighth transistor is electrically connected to the amplitude data signal terminal, and a gate of the eighth transistor is electrically connected to a fourth amplitude data-writing scanning-signal terminal; and wherein a first plate of the second capacitor is electrically connected to a second terminal of the eighth transistor, and a second plate of the second capacitor is electrically connected to the gate of the amplitude drive transistor;

wherein the amplitude storage unit comprises an amplitude storage capacitor, a first plate of the amplitude storage capacitor is electrically connected to a first power terminal, and a second plate of the amplitude storage capacitor is electrically connected to the gate of the amplitude drive transistor;

wherein the amplitude adjustment unit comprises an amplitude adjustment transistor, a first terminal of the amplitude adjustment transistor is electrically connected to the first power terminal, a second terminal of the amplitude adjustment transistor is electrically connected to the first terminal of the amplitude drive transistor, and a gate of the amplitude adjustment transistor is electrically connected to an amplitude light emission signal terminal;

wherein the amplitude light emission control unit comprises an amplitude light emission control transistor, a first terminal of the amplitude light emission control transistor is electrically connected to the second terminal of the amplitude drive transistor, a second terminal of the amplitude light emission control transistor is electrically connected to the light-emitting element, and a gate of the amplitude light emission control transistor is electrically connected to the amplitude light emission signal terminal; and wherein the amplitude reset unit comprises an amplitude reset transistor, a first terminal of the amplitude reset transistor is electrically connected to a reference voltage terminal, a second terminal of the amplitude reset transistor is electrically connected to the gate of the amplitude drive transistor, and a gate of the amplitude reset transistor is electrically connected to an amplitude reset scanning-signal terminal.

13. A display panel comprising the pixel driving circuit according to claim 1.

14. A display device comprising the display panel according to claim 13.

15. A pixel driving circuit comprising a pulse-width adjustment module, an amplitude adjustment module and a light-emitting element, wherein the pulse-width adjustment module comprises a pulse-width drive transistor and a pulse-width adjustment unit, the pulse-width drive transistor comprises a first terminal, a second terminal and a control terminal, a control terminal of the pulse-width adjustment unit is electrically connected to a pulse-width light emission signal terminal, a first terminal of the pulse-width adjustment unit is electrically connected to a sweep signal terminal, and a second terminal of the pulse-width adjustment unit is electrically connected to the first terminal of the pulse-width drive transistor; and wherein an input terminal of the amplitude adjustment module is electrically connected to an output terminal of the pulse-width adjustment module, and an output terminal of the amplitude adjustment module is electrically connected to the light-emitting element.

16. A driving method of a pixel driving circuit, wherein the pixel driving circuit comprises a pulse-width adjustment module, an amplitude adjustment module and a light-emitting element;

the pulse-width adjustment module is electrically connected to a sweep signal terminal and comprises a pulse-width drive transistor; and a working process of the pixel driving circuit comprises a light emission stage;

wherein the driving method comprises:

in the light emission stage, supplying, by the pulse-width drive transistor, a sweep signal supplied from the sweep signal terminal to the amplitude adjustment module, and controlling, by the amplitude adjustment module, a light emission duration of the light-emitting element according to the sweep signal; and wherein the pulse-width adjustment module further comprises a pulse-width storage capacitor, a first plate of the pulse-width storage capacitor is electrically connected to a second voltage terminal, and voltages supplied from the second voltage terminal comprise a first voltage value and a second voltage value that are different from each other; and the working process of the pixel driving circuit further comprises a data-writing stage; and the driving method further comprises:

in the data-writing stage, supplying a voltage having the first voltage value from the second voltage terminal; and in the light emission stage, supplying a voltage having the second voltage value from the second voltage terminal;

or, the pulse-width adjustment module further comprises a pulse-width storage capacitor and a feedthrough capacitor, the pulse-width storage capacitor is configured to store a pulse-width data signal, and the feedthrough capacitor is configured to boost the pulse-width data signal stored in the pulse-width storage capacitor;

a first plate of the feedthrough capacitor is electrically connected to a third voltage terminal, and voltages supplied from the third voltage terminal comprise a third voltage value and a fourth voltage value that are different from each other; and the working process of the pixel driving circuit further comprises a data-writing stage; and the driving method comprises:

supplying a voltage having the third voltage value from the third voltage terminal in the data-writing stage; and supplying a voltage having the fourth voltage value from the third voltage terminal in the light emission stage.

* * * * *